US012757973B2

(12) United States Patent
Bache et al.

(10) Patent No.: US 12,757,973 B2
(45) Date of Patent: Oct. 13, 2026

(54) SHOE, IN PARTICULAR SPORTS SHOE, AND METHOD FOR MANUFACTURING SUCH A SHOE

(71) Applicant: DECATHLON, Villeneuve d'Ascq (FR)

(72) Inventors: Melvin Bache, Villeneuve d'Ascq (FR); Giampietro Chiaf, Villeneuve d'Ascq (FR); Mohammad Nurul Huda Khan, Villeneuve d'Ascq (FR); Aurélia Ruer, Villeneuve d'Ascq (FR)

( * ) Notice: Subject to any disclaimer, the term of this patent is extended or adjusted under 35 U.S.C. 154(b) by 0 days.

(21) Appl. No.: 18/840,996

(22) PCT Filed: Feb. 23, 2023

(86) PCT No.: PCT/EP2023/054623
§ 371 (c)(1),
(2) Date: Aug. 23, 2024

(87) PCT Pub. No.: WO2023/161382
PCT Pub. Date: Aug. 31, 2023

(65) Prior Publication Data

US 2025/0151840 A1 May 15, 2025

(30) Foreign Application Priority Data

Feb. 25, 2022 (FR) ..... 2201672

(51) Int. Cl.
*A43B 5/00* (2022.01)
*A43B 23/02* (2006.01)

(52) U.S. Cl.
CPC ..... *A43B 5/00* (2013.01); *A43B 23/0245* (2013.01)

(58) Field of Classification Search
CPC ..... A43B 5/00; A43B 23/042; A43B 23/024; A43B 23/0245; A43B 23/0255; A43B 23/0275; A43B 1/05; A43B 1/0072; A43B 1/04; D04B 1/04; D04B 1/12; D04B 1/24; D10B 2501/043; B32B 5/02; B32B 5/26; B32B 2262/0261; B32B 2262/12
USPC ..... 428/36.1
See application file for complete search history.

(56) References Cited

U.S. PATENT DOCUMENTS

2014/0031098 A1 1/2014 Tacconi

FOREIGN PATENT DOCUMENTS

FR 3098690 A 1/2022

OTHER PUBLICATIONS

English language abstract of FR3098690.

*Primary Examiner* — Camie S Thompson

(57) ABSTRACT

The subject of the invention is a shoe (100) comprising an upper (110) comprising at least a part (142) of an outer textile tubular element (140), and at least a part (132) of an inner textile tubular element (130), which are at least partially superimposed, at least one of said inner (130) and outer (140) textile tubular elements comprises at least one hot-melted textile portion. Advantageously, the outer textile tubular element (140) comprises at least one main outer textile portion (142) and the inner textile tubular element (130) comprises at least one main inner textile portion (132), at least partially superimposed, and the main outer textile portion (142) comprises one or more transparent and/or translucent monofilament yarns forming an area of visualization of the main inner textile portion (132).
The invention also has the subject of a method for manufacturing such a sports shoe (100).

19 Claims, 8 Drawing Sheets

SHOE, IN PARTICULAR SPORTS SHOE, AND METHOD FOR MANUFACTURING SUCH A SHOE

TECHNICAL FIELD

This Application relates to the technical field of articles of footwear, in particular sports shoes, comprising two textile tubular elements used in the construction of the upper and optionally of the sole of said articles of footwear, and the methods for manufacturing such articles of footwear.

PRIOR ART

Conventional articles of footwear generally comprise an upper and a sole structure. The upper is secured to the sole structure and forms a void inside the article of footwear to receive and secure a foot comfortably. The sole structure is secured to a lower area of the upper, and disposed in operation between the ground and the upper.

In articles of footwear for practicing a sport, the sole structure may comprise an outsole and a midsole. The midsole often comprises a material made of polymer foam which absorbs shocks with the ground in the event of an impact in order to attenuate the effects on the foot and the leg during walking, running or other ambulatory activities. The sole structure can also comprise a lining positioned in proximity to the lower surface of the foot to improve the comfort of the article of footwear.

The soles are conventionally secured to the uppers using a construction known as the Strobel construction during which the different sole elements (insole, midsole and outsole in particular) are assembled. The methods for manufacturing a conventional shoe require dozens of steps, and produce a great deal of scrap from cut-out material.

It is desirable to simplify the methods for manufacturing articles of footwear, particularly by reducing the number of steps and/or consumption of energy and materials. This issue is also part of the search for a manufacturing method that can be implemented as near as possible to the place of use of the article of footwear in order to reduce its carbon impact, facilitate stock management, and allow the personalization of the article of footwear.

One solution consists in eliminating the sewing steps needed to shape the initially flat upper in three dimensions. The upper is obtained from the assembly of one or more parts, and no longer from multiple parts attached together by sewing.

Articles of footwear are therefore known comprising a textile tubular element comprising hot-melted textile portions forming the upper, at least in part. It is thus desirable to improve these articles of footwear so that they are light, flexible, and breathable, while offering satisfactory resistance to abrasion and tearing, and comfortably fitting the shape of the foot.

FR 3 098 690 A1 describes the manufacturing of a shoe from two superimposed textile tubular elements comprising yarns, at least partially hot-meltable, which are hot-melted during the hot-melting of the two textile tubular elements into one upper. FR 3 098 690 A1 describes that it is possible to use different stitching patterns and different types of yarn (plain and/or color and/or transparent, see [0126]) but without specifying the type of yarn, or its disposition in the shoe.

Such articles of footwear, while having a particular construction, must also offer varied designs meeting the technical criteria set out above, while limiting the esthetic and/or functional component(s) required to manufacture them.

It can thus be desirable to form one or more areas of visualization of a particular portion of the article of footwear from the outside of this latter. It is thus proposed to melt hot-meltable yarns and to form a transparent film-forming area. However, this type of film-forming area reduces breathability and flexibility of the upper when the hot-melted monofilament yarns have a large diameter or the abrasion/tear resistance when the hot-melted monofilament yarns have a small diameter. In addition, when the upper comprises an inner layer and an outer layer comprising hot-meltable yarns, these latters adhere to the inner layer when they are hot-melted, further stiffening the treated area of the upper.

It is thus desirable to form an area of visualization not altering the permeability, or at least limiting the reduction in permeability and maintaining good flexibility of the region of the upper comprising it, along with good resistance to abrasion and tearing, in particular when a through opening is disposed in this area of visualization.

SUMMARY OF THE INVENTION

The subject of this Application, according to a first aspect, is a shoe, in particular a sports shoe, comprising an upper, said upper comprising at least a part of an outer textile tubular element, and at least a part of an inner textile tubular element, said inner and outer textile tubular elements being at least partially superimposed, at least one of said inner and outer textile tubular elements comprising at least one hot-melted textile portion.

Advantageously, the outer textile tubular element comprises at least one main outer textile portion and the inner textile tubular element comprises at least one main inner textile portion, the main outer textile portion and the main inner textile portion are at least partially superimposed, and the main outer textile portion comprises one or more transparent and/or translucent monofilament yarns forming an area of visualization of the main inner textile portion.

Advantageously, the upper is hot-melted, optionally hot-compressed, using one or more hot-melted textile portions or one or more partially hot-melted textile portions.

Advantageously, the area of visualization is formed of one or more transparent and/or translucent monofilament yarn(s) contributing stiffness and preserving permeability due to the spaces present between the yarn or yarns of the main outer textile portion.

Inner Textile Tubular Element

Advantageously, the inner textile tubular element is woven or knitted, preferably knitted.

Preferably, the inner textile tubular element comprises one or more monofilament yarn(s) and/or one or more multifilament yarn(s), and/or one or more yarn(s) spun from fibers.

Preferably, the inner textile tubular element comprises one or more at least partially hot-meltable/hot-melted yarn(s), still preferably the hot-melted portion or portions of the yarn or yarns respectively forms or form one or more of the hot-melted textile portion (s.

The inner textile tubular element may comprise:

- one or more yarn(s) spun from fibers and/or one or more multifilament yarn(s) and/or one or more monofilament yarn(s), non-meltable/non-hot-melted, and/or
- one or more partially or entirely hot-meltable/hot-melted multifilament yarn(s), and/or
- one or more partially or entirely hot-meltable/hot-melted monofilament yarn(s).

The inner textile tubular element preferably comprises an at least partially foot-housing volume, and an opening for insertion of the foot into said housing volume.

Advantageously, the inner textile tubular element comprises an at least partially foot-covering inner textile part, comprising said main inner textile portion.

In particular, the inner textile tubular element comprises an at least partially foot-covering inner textile part and a sole inner textile part in textile connection, particularly knitted, with the covering inner textile part.

Advantageously, the at least partially foot-covering inner textile part, and the sole inner textile part are made of a textile piece of unitary textile construction, in particular of unitary knitted construction, more particularly the inner textile tubular element is a knitted piece of unitary knitted construction.

The at least partially foot-covering inner textile part may cover the entirety or one or more regions of the top of the foot.

The sole inner textile part can cover the entirety or one or more region(s) of the bottom of the foot.

The covering inner textile part is arranged according to the desired configuration of the upper.

Advantageously, the region(s) of the top of the foot in which the at least partially foot-covering inner textile part extends is/are chosen from among:

the forefoot region extending over the lateral side and/or the forefoot region extending over the medial side; and/or the forefoot region extending between the lateral and medial sides; and/or the instep area; and/or the midfoot region extending over the lateral side; and/or the midfoot region extending over the medial side; and/or the heel region extending over the lateral side and/or the heel region extending over the medial side; and/or the heel region extending between the lateral side and the medial side; and/or the leg region extending partly above the malleolus.

Advantageously, the region or regions of the bottom of the foot in which the sole inner textile portion extends is/are chosen from among: the forefoot region extending between the lateral and medial sides; and/or the midfoot region extending between the lateral and medial sides; and/or the heel region extending between the lateral and medial sides.

In an embodiment, the inner textile tubular element comprises an end forming a pouch for the toes extending all the way into a heel area.

Preferably, the inner textile tubular element is an inner knitted sock.

Preferably, the inner textile tubular element comprises an outer face and an inner face, in particular substantially opposite one another.

Preferably, the main inner textile portion extends between the inner and outer faces of the inner textile tubular element, in particular the inner and outer faces of the main inner textile portion are portions of the inner and outer faces of the inner textile tubular element.

Outer Textile Tubular Element

Advantageously, the outer textile tubular element is woven or knitted, preferably knitted.

Preferably, the outer textile tubular element comprises one or more monofilament yarn(s) and/or one or more multifilament yarn(s) and/or one or more yarn(s) spun from fibers.

Preferably, the outer textile tubular element comprises one or more at least partially hot-meltable/hot-melted yarn (s), still preferably the hot-melted portion or portions of the yarn or yarns respectively forms or form one or more of the hot-melted textile portions.

The outer textile tubular element may comprise:

one or more yarn(s) spun from fibers and/or one or more multifilament yarn(s) and/or one or more monofilament yarn(s), in particular non-meltable/non-hot-melted, and/or one or more at least partially or entirely hot-meltable/hot-melted multifilament yarn(s), and/or one or more at least partially or entirely hot-meltable/hot-melted monofilament yarn(s).

The outer textile tubular element preferably comprises an at least partially foot-housing volume, and an opening for inserting the foot into said housing volume.

Advantageously, the outer textile tubular element comprises an at least partially foot-covering outer textile part comprising said main outer textile portion.

In particular, the outer textile tubular element comprises an at least partially foot-covering outer textile part and a sole outer textile part in textile connection, particularly knitted, with the covering outer textile part.

Advantageously, the at least partially foot-covering outer textile part, and the sole outer textile part are made of a textile piece of unitary textile construction, in particular of unitary knitted construction, more particularly the outer textile tubular element is a knitted piece of unitary knitted construction.

The at least partially foot-covering outer textile part can cover the entirety or one or more regions of the top of the foot.

The sole outer textile part can cover the entirety or one or more regions of the bottom of the foot.

The covering outer textile part is arranged according to the desired configuration of the upper.

Advantageously, the region or regions of the top of the foot in which the at least partially foot-covering outer textile part extends is/are chosen from among: the forefoot region extending over the lateral side, and/or the forefoot region extending over the medial side; and/or the forefoot region extending between the lateral and medial sides; and/or the instep area; and/or the midfoot region extending over the lateral side; and/or the midfoot region extending over the medial side; and/or the heel region extending over the lateral side; and/or the heel region extending over the medial side; and/or the heel region extending between the lateral and the medial side; and/or the leg region extending partially above the malleolus.

Advantageously, the region or regions of the bottom of the foot in which the sole outer textile part extends is/are chosen from among: the forefoot region extending between the lateral and medial sides; and/or the midfoot region extending between the lateral and medial sides; and/or the heel region extending between the lateral and medial sides.

In an embodiment, the outer textile tubular element comprises an end forming a pouch for the toes extending all the way into a heel area.

Preferably, the outer textile tubular element is an outer knitted sock.

Preferably, the outer textile tubular element comprises an outer face and an inner face, in particular substantially opposite one another.

In a preferred exemplary embodiment, the inner textile tubular element is at least partially disposed in the volume for housing of the outer textile tubular element, in particular the outer face of the inner textile tubular element is disposed facing the inner face of the outer textile tubular element.

Preferably, the inner face is disposed facing, and particularly opens directly into, the foot-housing volume of the article of footwear.

Preferably, the main outer textile portion extends between the inner and outer faces of the outer textile tubular element, in particular the inner and outer faces of the main outer textile portion are portions of the inner and outer faces of the outer textile tubular element.

In an exemplary embodiment, the outer textile tubular element may comprise, besides the, main outer textile portion, an additional outer textile portion comprising one or more transparent and/or translucent monofilament yarn(s) forming an area of visualization of an additional inner textile portion that the inner textile tubular element comprises.

Preferably, the main outer textile portion is separated from the additional outer textile portion by an intermediate outer textile portion, still preferably the intermediate outer textile portion does not comprise one or more transparent and/or translucent monofilament yarn(s) and/or comprises one or more hot-melted textile portion(s).

Preferably, the additional outer textile portion extends between the inner and outer faces of the outer textile tubular element.

Preferably, the additional inner textile portion extends between the inner and outer faces of the inner textile tubular element.

Preferably, the additional inner and outer textile portions are at least partially superimposed.

The upper may comprise several pairs of additional inner and outer textile portions as described above, and in general in this text, depending on the desired technical effects, for example one, or two or three or four or more additional inner and outer textile portions.

The features defining the main outer textile portion and the main inner textile portion are applicable independently of one another to the additional outer and inner textile portions respectively.

Advantageously, an additional outer textile portion, or additional inner textile portion respectively, is distinct from a main outer textile portion, or a main inner textile portion respectively.

In an exemplary embodiment, the inner textile tubular element and the outer textile tubular element are secured to one another by way of one or more hot-melted textile portions, preferably the sole inner textile part is secured to the sole outer textile part by one or more hot-melted textile portion(s) and/or the covering inner textile part is secured to the covering outer textile part by one or more hot-melted textile portion(s).

In an exemplary embodiment, the upper comprises at least two textile portions, in particular at least two portions of one yarn or of several yarns, secured to one another by one or more hot-melted textile portions.

Preferably, the ratio of the total mass of one or more hot-melted textile portion(s) of the sole inner textile part of the inner textile tubular element with respect to the total mass of said sole inner textile part is greater than or equal to 50% or 60% or 70% or 80% or 90% or approximately 100%.

Preferably, the ratio of the total mass of one or more hot-melted textile portion(s) of the sole outer textile part of the outer textile tubular element with respect to the total mass of said sole outer textile part is greater than or equal to 50% or 60% or 70% or 80% or 90% or approximately 100%.

The sole inner and outer textile parts may thus comprise a significant quantity of at least partially hot-melted yarns.

The inner textile tubular element and/or the outer textile tubular element is/are preferably knitted on a circular knitting machine, the needle bed or beds of which is/are of small diameter, in particular suitable for knitting a sock.

Upper

Advantageously, the upper comprises, and in particular essentially consists of, the at least partially foot-covering inner textile part of the inner textile tubular element and the at least partially foot-covering outer textile part of the outer textile tubular element.

Advantageously, the upper comprises one or more region (s) covering the top of the foot chosen from among: a forefoot region extending over the lateral side and/or a forefoot region extending over the medial side; a forefoot region extending between the lateral and medial sides; an instep area; a midfoot region extending over the lateral side; and/or a midfoot region extending over the medial side; a heel region extending over the lateral side and/or a heel region extending over the medial side; a heel region extending between the medial and lateral sides, or a combination of these latters.

The upper may further comprise one or more esthetic components (logo, embroidery etc.) and/or one or more functional components, for example a front toe cap or a rear heel counter.

Sole Structure

Advantageously, the shoe comprises an upper and a sole structure secured to the upper.

The sole structure may comprise an outsole, and where applicable a midsole and/or an insole.

Advantageously, the outsole comprises an outer face of engagement with the ground.

The midsole can be disposed between the outsole and the upper.

The midsole can be alternatively disposed in the foot-housing volume of the shoe, and optionally can be removably secured to said housing volume.

Preferably, the sole structure of the shoe comprises the sole inner textile part of the inner textile tubular element and the sole outer textile part of the outer textile tubular element, and optionally also one or more sole elements.

Advantageously, a sole element, for example a midsole or an outsole, can be disposed between the sole inner textile part and the sole outer textile part.

Hot-Melted Textile Portion

The inner textile tubular element may comprise one or more hot-melted textile portion(s) and/or the outer textile tubular element may comprise one or more hot-melted textile portion(s) and/or the upper may comprise one or more hot-melted textile portion(s).

A hot-melted textile portion can be a portion:

- of a hot-meltable/hot-melted monocomponent or a bicomponent filament yarn comprising at least a first hot-meltable/hot-melted component and at least a second non-hot-meltable/non-hot-melted component or,
- a multifilament yarn comprising one or more hot-meltable/hot-melted monocomponent or bicomponent filament(s) comprising at least a first hot-meltable/hot-melted component and at least a second non-hot-meltable/non-hot-melted component, optionally in a mixture with one or more non-hot-meltable/non-hot-melted monocomponent filament(s).

A filament or a monofilament yarn, hot-meltable/hot-melted monocomponent, can be for example made of polyurethane, for example having a melting temperature of approximately 100° C.-120° C.

A filament or a monofilament yarn, bi-component, can be of core/sheath or side-by-side type, i.e. comprising a sheath or a side comprising said first component having a melting temperature of approximately 100° C.-120° C. and a core or the other side comprising said second component, in particular having a melting or softening temperature greater than that of the first component, for example ranging from 150° C. to 260° C., for example in the order of 250° C. in the case of polyester (for example polyethylene terephthalate).

For example, the first component can be made of polyester, or polyurethane respectively, and the second component can be made of polyester, or polyurethane respectively.

Area of Visualization

Advantageously, an area of visualization is an area though which it is possible to visualize from the outside of the main outer textile portion, i.e. from the outer face of said main outer textile portion, the outer face of the main inner textile portion, in particular the color or colors and/or a logo and/or one or more patterns (for example one or more through openings), of the outer face of the main inner textile portion.

Advantageously, the upper may comprise several areas of visualization, for example an area of visualization disposed in the forefoot region and/or an area of visualization disposed in the toe region, and/or an area of visualization disposed in the medial region, and/or an area of visualization disposed in the lateral region.

An area of visualization is a main or additional outer textile portion of the outer textile tubular element formed by one or more transparent and/or translucent monofilament yarn(s).

Yarn(s)

The transparent and/or translucent monofilament yarn or yarns can be uncolored or colored.

Preferably, the transparent and/or translucent monofilament yarn or yarns are not hot-meltable and/or is not/are not hot-melted. This disposition makes it possible to preserve the mobility between the yarn or yarns and to avoid altering the permeability of the portion, particularly of the main or additional outer (or respectively inner) textile portion, comprising said monofilament yarn or yarns.

The monofilament yarn or yarns and/or the yarn or yarns spun from fibers and/or the multifilament yarn or yarns, particularly non-hot-melted/non-hot-meltable, is/are made of one or more materials chosen from among:

- a list I comprising: polyesters, in particular chosen from among polyethylene terephthalate (PET) and polybutylene terephthalate (PBT) or a combination of these latters; polyamides, in particular chosen from among PA 6, PA 6-6, and a combination of these latters; polyolefins, in particular polyethylene, polypropylene, and a combination of these latters; elastanes; and a combination of these latters; and/or
- a list II comprising: cotton, regenerated cellulose, for example viscose, wool, and a combination of these latters.

A multifilament yarn can have a linear mass density ranging from 5 dtex to 500 dtex, in particular ranging from 5 dtex to 300 dtex, more particularly ranging from 5 dtex to 200 dtex or to 100 dtex.

In an exemplary embodiment, the monofilament yarn or yarns (in particular transparent or translucent) is/are one or more polyester monofilament yarn(s), for example made of polyethylene terephthalate (PET) or made of polybutylene terephthalate (PBT).

In an embodiment, the transparent or translucent monofilament yarn or yarns (each) has/have:

- a linear mass density ranging from 5 deniers to 100 deniers, in particular ranging from 5 deniers to 60 deniers, more particularly ranging from 20 deniers to 40 deniers (particularly measured as per the ASTM-D-844 standard); and/or
- a diameter greater than or equal to 0.01 mm and less than or equal to 1 mm, in particular greater than or equal to 0.03 mm or to 0.05 mm, more particularly less than or equal to 0.50 mm or to 0.35 mm, still more particularly less than or equal to 0.15 mm; and/or
- a tenacity ranging from 1 g/denier to 20 g/denier, in particular ranging from 1 g/denier to 15 g/denier, more particularly ranging from 3 g/denier to 7 g/denier (particularly measured as per the DIN 53834-1 standard, particularly from 1976); and/or
- an elongation at break ranging from 5% to 80%, in particular ranging from 5% to 50%, more particularly ranging from 15% to 50% (particularly measured as per the DIN 53834-1 standard, particularly dating from 1976); and/or
- a three-lobed cross-section.

In a preferred exemplary embodiment, the monofilament yarn or yarns, particularly transparent and/or translucent, is/are one or more yarn(s) made of one or more thermoplastic elastomer(s), especially one or more thermoplastic olefinic elastomer(s), in particular as described hereinafter. Advantageously, the inventors have determined that the linear mass density and the diameter mentioned above facilitate the implementation of said monofilament yarn on a textile loom, in particular by knitting, while offering a good trade-off between stiffness and flexibility.

Advantageously, the three-lobed cross-section can be recognized on a microscope.

Advantageously, the three-lobed cross-section confers gloss on the area of visualization.

Definitions

In this text the term "hot-meltable" or "first hot-meltable component" should be understood to mean any material or first component that is hot-melted during the manufacturing of the shoe.

In this text the term "foot insertion opening of the shoe, of a sock (inner or outer), or else a textile tubular element (inner or outer)", should be understood to mean the natural opening for insertion of the foot into the foot-housing volume of the shoe, of the sock or of the textile tubular element, in particular disposed between the midfoot and hindfoot regions, more particularly surrounding all or part of the ankle.

In this text the term "non-hot-meltable" should be understood to mean any material/component that is not hot-melted during the manufacturing of the shoe. This material or component can be a thermoplastic or non-thermoplastic material, but has a melting or softening temperature or else a degradation temperature which is greater than the highest heating temperature involved during the manufacturing of the article of footwear.

In this text the term "transparent and/or translucent" should be understood to mean any material, in particular any monofilament, through which it is possible to visualize one or more colors, and/or one or more patterns, optionally in relief.

It is possible to vary the transparency of a monofilament yarn until it is translucent, for example by varying the mass percentage of titanium dioxide in said yarn.

In this text the term "at least partially hot-meltable yarn or yarns" should be understood to mean that said yarn or yarns is/are totally hot-meltable or each comprises/comprise a portion of their structure that is hot-meltable.

In a variant embodiment, the main inner textile portion comprises one or more transparent and/or translucent monofilament yarn(s), particularly forming an inner area of visualization.

In a variant embodiment, the inner textile tubular element, in particular the at least partially foot-covering inner textile part, comprises:

- one or more hot-melted textile portion(s), in particular one or more at least partially hot-meltable yarn(s) which is/are at least partially hot-melted during the manufacturing of the shoe; and/or
- one or more multifilament yarn(s) and/or one or more yarn(s) spun from fibers, in particular non-hot-melted, more particularly made of polyester and/or recycled, for example made of PET (polyethylene terephthalate) or of PBT (polybutylene terephthalate); and/or
- one or more elastic yarns, in particular made of elastane; and/or
- one or more transparent and/or translucent monofilament yarn(s), in particular non-hot-melted, arranged in the main, or respectively additional, inner textile portion, at least partially superimposed with the main, or respectively additional, outer textile portion of the outer textile tubular element.

In a variant embodiment, the outer textile tubular element, in particular the at least partially foot-covering outer textile part, comprises:

- one or more hot-melted textile portion(s), in particular one or more at least partially hot-meltable yarn(s) which is/are at least partially hot-melted during the manufacturing of the shoe; and/or
- one or more non-hot-melted multifilament yarn(s) and/or one or more yarn(s) spun from fibers, in particular non-hot-melted, more particularly made of polyester and/or recycled, for example made of PET (polyethylene terephthalate) or PBT (polybutylene terephthalate); and/or
- one or more elastic yarn(s), in particular made of elastane; and/or
- one or more transparent and/or translucent monofilament yarn(s), in particular non-hot-melted, arranged in the main, or respectively additional, outer textile portion substantially superimposed with the main, or respectively additional, inner textile portion of the inner textile tubular element.

In a variant embodiment, the inner textile tubular element and/or the outer textile tubular element each comprises/comprise, in the region encircling all or part of the foot insertion opening, one or more elastic yarn(s); in particular said region does not comprise any hot-melted textile portion.

In a variant, the inner, or respectively outer, textile tubular element, in particular the at least partially foot-covering inner, or respectively outer, textile part, comprises in its forefoot region extending between the medial and lateral sides and/or in the instep area, one or more lace buckle(s) of unitary textile construction, particularly knitted, with the inner, or respectively outer, textile tubular element, in particular with the at least partially foot-covering inner, or respectively outer, textile part.

Advantageously, when the lace buckles are arranged on the inner textile tubular element, the outer textile tubular element comprises, in its forefoot region extending between the medial and lateral sides and/or in the instep area, one or more receiving through openings configured to allow said lace buckles to pass through, said receiving through opening or openings respectively, so as to project outside of said receiving through opening or openings.

In an embodiment, a lace buckle is delimited by two through openings, particularly of unitary textile construction, in particular knitted, with the inner, or respectively outer, textile tubular element. Said two openings are preferably disposed in the forefoot region extending between the lateral and medial sides and/or in the instep area.

For example, a lace buckle is a knitted bridge.

In particular, the instep area and/or the forefoot region extending between the lateral and medial sides of the inner, or respectively outer, textile tubular element, comprises first and second sets of lacing through openings. Each of the first and second sets of lacing through openings comprises several, for example between three and six, pairs of two openings, the two openings of each pair being separated by a knitted portion forming first or second bridges. More particularly, the first bridges and the second bridges, of the first and second sets of through openings respectively, are disposed along a transverse direction T substantially perpendicular to the longitudinal axis L of the inner and outer textile tubular elements.

In an embodiment, a lace buckle is formed by a weft knitted yarn, said buckle projecting from the outer face, in particular of the forefoot region disposed between the lateral and medial sides and/or the instep area, of the outer, or respectively inner, textile tubular element.

In a variant embodiment, the transparent and/or translucent monofilament yarn or yarns is not/are not hot-melted.

Advantageously, the areas where the yarn or yarns intersect with one another, in particular the stitches knitted with said yarn or yarns, are movable with respect to one another. This disposition imparts flexibility to said main outer textile portion, and improves permeability. Said main outer textile portion thus makes it possible to expel heat and/or transpiration.

In a variant, at least one yarn chosen from among the transparent and/or translucent monofilament yarn or yarns of the main outer textile portion comprises a thermoplastic elastomer, in particular an olefinic thermoplastic elastomer.

The knitting of a monofilament yarn, in particular transparent and/or translucent, on a circular knitting machine is difficult since the monofilament yarn must adopt the curvature of the successive knitted loops but also the tubular shape of the textile tubular element. If the monofilament yarn is not suitable, it tends to snap on the knitting machine and/or generate a different tautness on the tubular element compared to a multifilament yarn, thus creating a non-uniform appearance.

In addition, this monofilament yarn is combined with at least one at least partially hot-meltable yarn in a knitted tubular element, which knitted tubular element undergoes a step of thermoforming or thermocompression.

An excessively stiff and/or coarse monofilament yarn does not provide satisfaction. This is because the knitted tubular element shaped by thermoforming or thermocompression with an unsuitable monofilament yarn does not have an esthetically pleasing and uniform surface effect, which can also create discomfort for the user when worn.

Advantageously, the use of a transparent and/or translucent monofilament yarn in a thermoplastic elastomer contributes to the obtainment of a uniform textile tubular element, able to undergo a step of thermoforming or thermocompression for the manufacturing of an upper that retains a uniform appearance. In addition, this monofilament yarn makes it possible to knit loosely, i.e. without exerting significant tension on this latter, which facilitates the step of heat-shrinking described hereinafter.

Preferably, said thermoplastic elastomer or elastomers, particularly olefinic, represents or account for at least 50% by mass, still preferably at least 80% by mass, as a preference at least 90% by mass, of the total mass of said at least one monofilament yarn.

In this text the term "an olefinic thermoplastic elastomer" should be understood to mean any elastomer comprising olefinic repeating units, particularly based on propylene and/or ethylene. Said olefinic thermoplastic elastomer may be chosen from among:

- the polyisobutenes (PIB); and/or
- ethylene propylene diene terpolymers (EPDM); ethylene and propylene copolymers; ethylene-alpha-olefin copolymers, for example ethylene and butene copolymers or ethylene and octene copolymers, and a blend of these latters; preferably EPDM and ethylene and propylene copolymers; and/or
- the blends of a polyolefin, in particular polypropylene, with one or more olefinic thermoplastic elastomers, non-vulcanized, and optionally one or more plasticizers (for example mineral or naphthenic or paraffin or oil oils); and/or
- said olefinic thermoplastic elastomer or elastomers can be ethylene and propylene copolymers, ethylene propylene diene terpolymers, ethylene-alpha-olefin copolymers (for example ethylene and butene copolymers or ethylene and octene copolymers).

Said at least one transparent and/or translucent monofilament yarn may comprise one or more thermoplastic elastomers.

In an embodiment, at least 80% by mass, preferably approximately 100% by mass, of said main outer textile portion is formed of one or more monofilament yarns (each) comprising one or more thermoplastic elastomer(s), particularly one or more olefinic thermoplastic elastomer(s).

Advantageously, this diameter interval makes it possible to knit said monofilament yarn on a circular knitting machine, and to obtain a uniform upper.

In a sub-variant, at least one yarn chosen from among the transparent and/or translucent monofilament yarn or yarns of the main outer textile portion has at least one of the following properties:

- has a linear mass density ranging from approximately 50 dtex to approximately 300 dtex, preferably ranging from approximately 50 dtex to approximately 200 dtex, still preferably ranging from approximately 100 dtex to approximately 200 dtex; and/or
- has a diameter greater than or equal to 0.05 mm and less than or equal to 0.8 mm, preferably greater than or equal to 0.08 mm and less than or equal to 0.3 mm; and/or
- comprises one or more thermoplastic elastomer(s), particularly olefinic; and/or
- has a tenacity (cN/tex) greater than or equal to 10 cN/tex, in particular less than or equal to 100 cN/tex, more particularly less than or equal to 50 cN/tex; and/or
- has an elongation at break greater than or equal to 40%, in particular greater than or equal to 60%, more particularly less than or equal to 100%.

The elongation at break and the tenacity can be determined using the ISO 2062:2009 standard, titled Textiles—Yarns from packages—Determination of single-end breaking force and elongation at break using constant rate of extension (CRE) tester, the extension rate can for example be 100 mm/min.

In a variant embodiment, said main outer textile portion, and optionally said main inner textile portion, is/are disposed in at least one of the following regions of the upper: a forefoot region extending over the lateral side and/or a forefoot region extending over the medial side; an instep area; a forefoot region extending between the lateral and medial sides; a midfoot region extending over the lateral side and/or a midfoot region extending over the medial side; a heel region extending over the lateral side and/or a heel region extending over the medial side; a heel region extending between the medial and lateral sides, or a combination of these latters, preferably a forefoot region extending over the lateral side and/or a forefoot region extending over the medial side; and/or an instep area; and/or a forefoot region extending between the lateral and medial sides; a midfoot region extending over the lateral side and/or a midfoot region extending over the medial side.

Advantageously, the main outer textile portion occupies at least 10%, preferably at least 20% or 30% or 40% or 50% or 60% or 70% or 80%, of the outer face of the upper or of the outer face of the at least partially foot-covering textile part of the outer textile tubular element.

In a variant embodiment, said main inner textile portion is disposed in at least one of the following regions of the upper: a forefoot region extending over the lateral side and/or a forefoot region extending over the medial side; a forefoot region extending between the lateral and medial sides; an instep area; a midfoot region extending over the lateral side and/or a midfoot region extending over the medial side; a heel region extending over the lateral side; and/or a heel region extending over the medial side; a heel region extending between the medial and lateral sides, or a combination of these latters, preferably a forefoot region extending over the lateral side and/or a forefoot region extending over the medial side; and/or an instep area; and/or a forefoot region extending between the lateral and medial sides; a midfoot region extending over the lateral side and/or a midfoot region extending over the medial side.

Advantageously, the main inner textile portion occupies at least 10%, preferably at least 20% or 30% or 40% or 50% or 60% or 70% or 80%, of the outer face of the upper or of the outer face of the foot-covering textile part of the inner textile tubular element.

In a variant embodiment, the outer textile tubular element is a knitted sock comprising a foot-receiving void, and the inner textile tubular element is a knitted sock at least partially disposed in the foot-receiving void of the outer textile tubular element.

Advantageously, the knitted sock of the inner or outer textile tubular element, comprises a heel area, a foot tip end, in particular closed by a seam or a weld, and a foot insertion opening.

Advantageously, the inner and outer textile tubular elements are at least partially superimposed.

In an embodiment, the inner and outer textile tubular elements are two distinct knitted pieces. This disposition facilitates differentiation, in particular regarding the dimensions and/or configurations (for example the disposition of an additional knitted pouch of unitary knitted construction with a knitted textile tubular element), between the inner, or respectively outer, textile tubular element, and the outer, or respectively inner, textile tubular element.

In a variant embodiment, the outer textile tubular element and the inner textile tubular element are of unitary textile construction.

Advantageously, the inner and outer textile tubular elements are made of a single textile piece, in particular of unitary textile construction, more particularly of unitary knitted construction.

Preferably, said piece has a general U shape before folding of the inner textile tubular element into the foot-housing volume of the outer textile tubular element (in particular this folding is done in the method for manufacturing the shoe in a second aspect).

Preferably, the inner sock is in a folded position in the foot-housing volume of the outer sock.

The folding of the inner sock begins at the level of their foot insertion openings or at the level of their open foot tips.

In a variant embodiment, the foot insertion opening, or respectively the foot tip, of the outer textile tubular element is in textile connection, particularly knitted, with the foot insertion opening, or respectively the foot tip, of the inner textile tubular element.

The folding is thus done starting from the foot insertion opening or starting from the open toe tip during the manufacturing method.

In a variant embodiment, the main inner textile portion does not comprise any hot-melted textile portion.

Advantageously, the peripheral region of the upper bordering all or part of the at least partially superimposed main inner and outer textile portions, comprises one or more hot-melted textile portions, in particular securing the foot-covering inner textile part with the foot-covering outer textile part.

In a variant embodiment, the main inner textile portion comprises one or more non-hot-melted, monofilament yarn(s), optionally transparent and/or translucent.

Preferably, said yarn or yarns form(s) an inner area of visualization, substantially facing the area of visualization of the main outer textile portion (which can be described as the outer area of visualization).

Advantageously, the inner area of visualization makes it possible to visualize the inside of the housing volume of the shoe, and therefore the part of the foot facing said area.

In a variant embodiment, the inner textile tubular element, in particular its at least partially foot-covering inner textile part, comprises one or more hot-melted textile portion(s), and the outer textile tubular element, in particular its foot-covering outer textile part, does not comprise any hot-melted textile portion or one or more hot-melted textile portion(s) of a total mass less than or equal to 0.50 times the total mass of the hot-melted textile portion or portions of the inner textile tubular element, in particular less than or equal to 0.50 times the total mass of the hot-melted textile portion or portions of the foot-covering inner textile part.

Advantageously, the outer textile tubular element comprises less hot-melted textile material than the inner textile tubular element.

This disposition makes it possible to obtain an outer tubular element which offers more flexibility, and is more breathable, than the inner tubular element.

In a variant embodiment, the main, or additional, outer textile portion, and/or the main, or additional, inner textile portion each comprises/comprise one or more textile through openings, in particular knitted, particularly with one or more monofilament yarns (as described in this text, for example transparent and/or translucent) or with one or more multifilament yarns.

Preferably, the through opening or openings extend between the inner and outer faces of the main, or additional, outer textile portion and/or the main, or additional, inner textile portion.

The main, or additional, outer, or respectively inner, textile portion, may comprise through openings:

- distributed in a given region of said main, or additional, portion, for example a given forefoot region of the covering textile part, and/or
- surrounding at least a part of said main, or additional, portion, in a given region, for example in a midfoot region on the lateral or medial side of the covering textile part, and/or
- a region of the upper less exposed to tensile or shear stress.

The through opening or openings comprises/comprise (or is/are) one or more through openings, in particular at least 3 or 4 or 5 or more than 5 through openings, (each) having at least one dimension greater than or equal to 1 mm or to 2 mm or to 3 mm or to 4 mm or to 5 mm or to 8 mm, or else greater than or equal to 10 mm, in particular the through opening or openings is/are defined as being one or more through openings A.

The through opening or openings comprises/comprise (or is/are) one or more through openings, in particular at least 3 or 4 or 5 or more than 5 through openings, (each) having at least one dimension less than or equal to 20 mm or to 15 mm or to 8 mm or to 5 mm or to 4 mm or to 3 mm or to 2 mm or to 1 mm, in particular the through opening or openings is/are defined as being one or more through openings A.

In a preferred example, the through opening or openings comprises/comprise (or is/are) one or more through openings having at least one dimension ranging from 3 mm to 15 mm, preferably ranging from 5 mm to 15 mm, particularly of type A.

One or more of the through openings can have any shape, for example an ovoid, round, parallelepipedal (for example square or rectangular) shape.

The through opening or openings comprises/comprise one or more through openings, in particular at least 3 or 4 or 5 or more than 5 or more than 30 through openings, (each) having at least one dimension greater than or equal to 0.1 mm, or to 0.5 mm, and less than or equal to 1 or 2 mm, in particular the through opening or openings is/are defined as being one or more through openings B. For example, this type of opening or openings B is located on a main, or additional, inner or outer textile portion of knitted mesh type or of honeycomb structure.

In a preferred example, the through opening or openings comprises/comprise (or is/are) one or more through openings having at least one dimension ranging from 0.1 mm to 2 mm, preferably ranging from approximately 0.8 mm to 2 mm, particularly of type B.

Advantageously, the through opening or openings, in particular A and/or B, is/are knitted with one or more transparent and/or translucent monofilament yarns, in particular non-hot-melted, or one or more multifilament yarn(s), particularly non-hot-melted.

This disposition makes it possible to form tear-resistant through openings.

This disposition also improves the flexibility, breathability and improves the display/visualization function of the main, or additional, outer, or respectively inner, textile portion.

In a first exemplary embodiment, the main, or additional, outer textile portion does not comprise any through openings and the main, or additional, inner textile portion comprises one or more through openings, in particular A and/or B, more particularly B.

Advantageously, the through opening or openings of the main, or additional, inner textile portion is/are knitted with one or more multifilament yarns.

In a second exemplary embodiment, the main, or additional, inner textile portion comprises/each comprise one or more textile through openings, in particular knitted, particularly with one or more monofilament yarns (as described in this text, for example transparent and/or translucent) or one or more multifilament yarn(s).

The dispositions of the first and second preceding examples advantageously make it possible to improve the tear-resistance of the upper since the through opening or openings arranged in the inner textile tubular element are covered by the outer textile tubular element, in particular said inner textile tubular element not comprising any through opening.

In a second exemplary embodiment, the main, or additional, inner textile portion does not comprise any through openings and the main, or additional, outer textile portion comprises one or more through openings, in particular A and/or B, more particularly A.

In a third exemplary embodiment, the main, or additional, inner textile portion comprises one or more through openings and the main, or additional, outer textile portion comprises one or more through openings each having at least one dimension greater than at least one of the dimensions of each of the through opening or openings of the main, or additional, inner textile portion, in particular the main, or additional, outer textile portion comprises one or more openings A and the main, or additional, inner textile portion comprises one or more through openings B.

In a variant embodiment, the main, or additional, outer textile portion comprises one or more through openings which is not/are not facing the through opening or openings of the main, or additional, inner textile portion.

This disposition makes it possible to protect the foot disposed in the housing volume of the shoe, for example from rain, dust, particulate etc.

In a variant embodiment, the main inner and outer textile portions are disposed at least partially, particularly entirely, in the midfoot region extending over the lateral side of the upper, and the inner textile tubular element further comprises an additional inner textile portion and the outer textile tubular element comprises an additional outer textile portion, the additional inner and outer textile portions are at least partially superimposed and disposed at least partially, particularly entirely, in the midfoot region on the medial side of the upper, the additional outer textile portion comprises one or more transparent and/or translucent monofilament yarns, in particular non-hot-melted, forming an area of visualization of the additional inner textile portion.

In a sub-variant embodiment, the upper further comprises another additional inner textile portion and another additional outer textile portion which are at least partially superimposed and disposed at least partially, particularly entirely, in the forefoot region disposed between the lateral and medial sides and optionally in the forefoot region disposed on the lateral side and/or the forefoot region disposed on the medial side.

In a variant embodiment, the main, or additional, outer textile portion comprises an inner face portion and the main, or additional, inner textile portion comprises an outer face portion which is not secured to the inner face portion of the main, or additional, outer textile portion, and in particular is not bonded by a hot-melted textile portion.

In a variant embodiment, the main, or additional, outer textile portion comprises one or more translucent and/or transparent monofilament yarn(s) each having a three-lobed cross-section, and preferably a linear mass density greater than or equal to 20 deniers and less than or equal to 60 deniers.

The inventors have determined that this disposition makes it possible to employ said monofilament yarn on a textile loom, in particular by knitting, while offering a good trade-off between stiffness and flexibility.

In addition, this type of yarn makes it possible to provide gloss.

In this text the term "three-lobed cross-section" should be understood to mean that the cross-section of a monofilament yarn comprises at least three sides.

Advantageously, a three-lobed cross-section has a substantially triangular general shape.

The subject, according to a second aspect, is a method for manufacturing a shoe, in particular a sports shoe, particularly as claimed in any of the variant embodiments according to a first aspect, the method advantageously comprising the steps:

i) one supplies an outer textile tubular element and an inner textile tubular element, of which at least one of said inner and outer textile tubular elements comprises at least one hot-meltable textile portion, the outer textile tubular element comprises at least one main outer textile portion and the inner textile tubular element comprises at least one main inner textile portion, the inner textile tubular element is at least partially disposed in a foot-receiving void of the outer textile tubular element such that said outer and inner textile tubular elements are at least partially superimposed, and that the main inner and outer textile portions are at least partially superimposed, the main outer textile portion comprising one or more transparent and/or translucent monofilament yarn(s), in particular having a melting temperature Tf or degradation temperature Td;

ii) one heats the inner and outer textile tubular elements to a heating temperature Tc such as to at least partially melt said at least one hot-meltable textile portion, in particular the temperature Tf or Td is greater than the heating temperature Tc;

iii) one obtains an upper comprising at least a part of the outer textile tubular element and at least a part of the inner textile tubular element, at least one of said inner and outer textile tubular elements comprises at least one hot-melted textile portion, and said at least one main outer textile portion forms an area of visualization of the main inner textile portion.

In an example, the method comprises a step of securing a sole structure to the sole outer textile part of the outer textile tubular element or to the upper obtained in step iii).

In an example, the method comprises a step of thermoforming or thermocompression during which one or more sole element(s) can be disposed between the sole inner textile part of the inner textile tubular element and the sole outer textile part of the outer textile tubular element or in contact with the sole textile part of the outer textile tubular element, in particular for securing by bonding, more particularly by bonding by one or more hot-melted textile portion(s).

The step of thermoforming, in particular the heating step ii), advantageously comprises the heat-setting of the at least partially foot-covering inner and outer textile parts of the inner and outer textile tubular elements to the shape of a preform in the general shape of a foot. The inner and outer textile tubular elements are maintained during their cooling under pressure against the preform so as to follow and hold the shape of the preform. The at least partially hot-meltable yarn or yarns can be bonded to one another.

The preform in the general shape of a foot is preferably disposed in the foot-housing volume of the inner textile tubular element, the textile tubular elements being at least partially superimposed.

The thermocompression step, in particular the heating step (ii), advantageously comprises the disposition of the inner and outer textile tubular elements, with one or more sole elements, in a mold. Preferably, an inflatable bladder (in particular made of silicone), particularly being substantially foot-shaped, is disposed in the foot-housing volume of the inner textile tubular element, which inner textile tubular element is at least partially superimposed with the outer textile tubular element. During the thermocompression, the inflatable bladder is inflated, for example to an inflation pressure ranging from approximately 3 bars to approximately 6 bars, in order to compress the inner and outer textile tubular elements, and optionally the sole element or elements, against the inner face of the mold. The mold can be made in two or three parts. For example two mold parts are configured to receive and mold the upper and one mold part is configured to receive and mold the sole structure. The heating temperature during thermocompression is determined such that it causes the targeted hot-melted textile material or materials to melt and spread out.

Specifically, the shoe may comprise one or more textile materials which are hot-meltable by nature, but which is not/are not hot-melted during the manufacturing of the shoe. This textile material is thus considered as non-hot-meltable or non-hot-melted.

For example, the heating temperature is higher than or equal to 110° C. and less than or equal to 200° C., and in particular ranges from 110° C. to 160° C.

An inner, or respectively outer, textile tubular element, can be knitted on a circular knitting machine of small diameter. It can be a knit with weft stitches or with warp stitches, preferably with weft stitches.

After step (iii), the method may comprise a step of fastening one or more sole elements to the sole outer textile part of the outer textile tubular element, for example portions of rubber secured by bonding.

It is also possible to then screw metallic tips into protrusions projecting from the outer face of the sole outer textile part of the outer textile tubular element to form cleats.

The sole element, which can be disposed between the sole inner and outer textile parts of the inner and outer textile tubular elements respectively, is an outsole or an absorbing element, for example having a Shore A hardness greater than 30 and less than 80.

In a variant, at least the outer textile tubular element, and in particular the outer textile tubular element and the inner textile tubular element, undergoes (undergo) a step of heat-shrinking before step ii).

In a variant, at least one yarn chosen from among the transparent and/or translucent monofilament yarn or yarns of the main outer textile portion comprises one or more thermoplastic elastomers, in particular one or more olefinic thermoplastic elastomers.

In a variant, at least one yarn chosen from the transparent and/or translucent monofilament yarn or yarns of the main outer textile portion is chosen so as to have a heat shrink ratio greater than or equal to 5%, preferably greater than or equal to 7%, still preferably less than or equal to 20%, as a preference less than or equal to 15%.

This disposition makes it possible to enable the heat-shrinking of the monofilament yarn during the heat-shrinking step taking place before the step ii) of thermoforming or thermocompression.

Advantageously, the main outer textile portion, and optionally one or more other portions of the outer textile tubular element and/or of the inner textile tubular element, is (are) knitted with one or more transparent and/or translucent monofilament yarn(s) exerting a low degree of tension during knitting on this latter or these latters, i.e. "loosely". In addition, said transparent and/or translucent monofilament yarns have a significant (dimensional) shrink ratio.

Advantageously, the heat-shrinking step makes it possible to activate the dimensional shrinking (%) of the transparent and/or translucent monofilament yarn or yarns, and thus to obtain a main outer textile portion, and optionally in general an outer textile tubular element and/or an inner textile tubular element according to the disposition of the transparent and/or translucent monofilament yarn or yarns, which has a uniform knitted surface, and a shape adjusted to the preform, before the step ii) of thermoforming and/or thermocompression.

Advantageously, the step of heat-shrinking comprises the application of heat at least to said outer textile tubular element for a determined period so as to obtain the desired dimensional shrinking of said outer textile tubular element, and optionally of said inner textile tubular element, for example comprising the application of hot water (for example at 80° C.) or water vapor, for at least 5 seconds, for example for a period ranging from 30 seconds to 5 minutes. The shrinkage (%) of said at least one yarn or of the outer and/or inner textile tubular element or elements is evaluated by the following calculation: [(length of an area A, taken in the direction of the weft or in the direction of the wales of stitches, disposed in the inner/main outer textile portion before the heat-shrinking step; or so-called initial length)−(length of said area A taken in the chosen direction of the weft or of the wales of stitches, disposed in the main outer/inner textile portion after the heat-shrinking step; or said activated length)]/(initial length)*100.

Advantageously, the shrinkage measured on the transparent and/or translucent monofilament yarn is greater than or equal to 5%.

Advantageously, the shrinkage measured over an area A of said outer textile tubular element is greater than or equal to 5%.

The definitions, variants, examples and modes of embodiment according to a first aspect are applicable independently of one another to the second aspect.

DESCRIPTION OF THE DRAWINGS

The subject matter will be better understood on reading the following description of the embodiments of the subject matter given by way of non-limiting examples, with reference to the appended figures, wherein.

DESCRIPTION OF THE EMBODIMENTS

Figure 1:
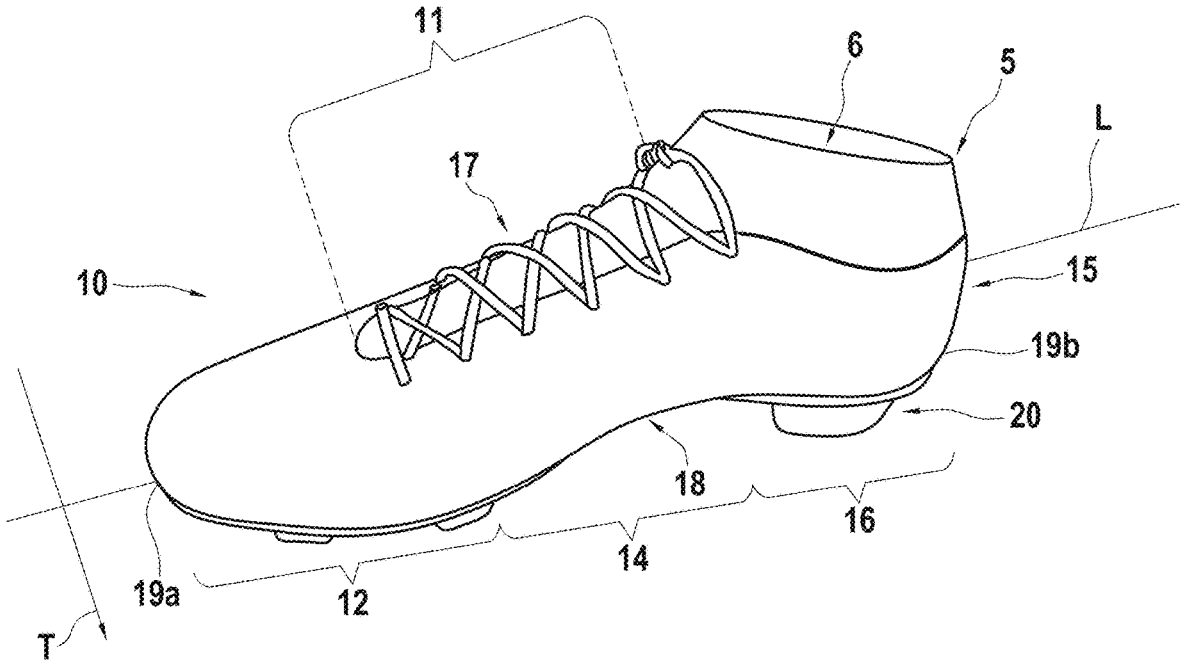
FIG. 1 schematically illustrates a first example of a shoe on which are represented the different regions of upper defined in this text with reference to the shoe.

For the purposes of reference to the terminology used in this text and associated with a shoe, the shoe 10 represented in FIG. 1 will be described hereinafter. The shoe 10 can be divided into three general regions: a forefoot region 12, a midfoot region 14 also known as the middle foot 14; and a heel or hindfoot region 16. The forefoot region 12 generally comprises parts of the shoe 10 corresponding to the toes and to the joints connecting the metatarsals to the phalanges. The midfoot region 14 generally comprises parts of the shoe 10 corresponding to the arch of the foot. The heel or hindfoot region 16 generally corresponds to the back parts of the foot, and particularly comprises the bone of the calcaneus. The shoe 10 also comprises a lateral 17 and a medial side 18, which each extend through regions of the forefoot 12, of the midfoot 14 and of the heel 16 and correspond to opposite sides of the shoe 10. More particularly, the lateral side 17 corresponds to an outer area of the foot, and the medial side 18 corresponds to an inner area of the foot. The shoe 10 comprises a foot insertion opening 5 making it possible to access the foot-receiving (or -housing) volume 6.

The shoe 10 comprises an instep area 11 extending in a substantially centered manner between the lateral side 17 and the medial side 18 in the midfoot region and optionally in the forefoot region 12.

The shoe 10 also comprises a longitudinal axis L and a transverse axis T, in particular substantially perpendicular to the axis L. The shoe 10 also comprises a front edge 19*a* and a back edge 19*b*. The article of footwear 10 comprises an upper 15 and a sole structure, particularly an outsole 20.

In addition to the shoe 10, the forefoot region 12, the midfoot region 14, the heel region 16, the lateral side 17, the medial side 18, the front edge 19*a*, the back edge 19*b*, the instep area 11, the foot insertion opening 5, and the foot housing or receiving volume 6, can be applicable to the sole structure 20, to the upper 15, and to their individual elements, such as for example without limitation to the inner and outer textile tubular elements and to their respective textile foot-covering parts and to their respective textile sole parts.

Figure 2:
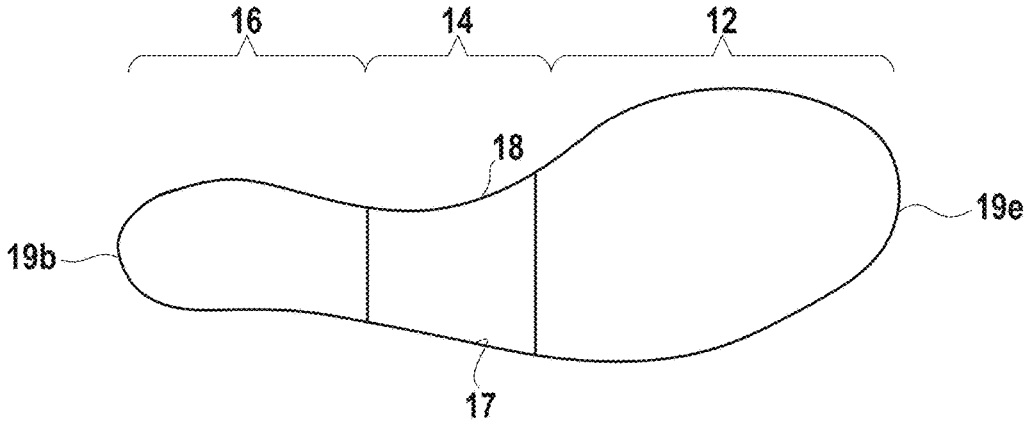
FIG. 2 schematically illustrates for reference purposes within this text, the different regions that the sole structure of the shoe represented in FIG. 1 may comprise.

FIG. 2 schematically represents, for reference purposes, the different regions that a sole structure 20 may comprise, corresponding to the regions defined in FIG. 1.

Figure 3:
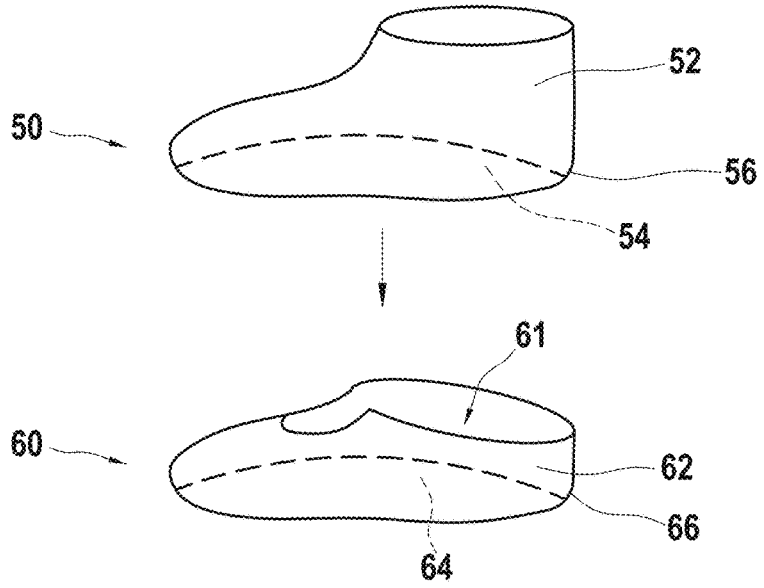
FIG. 3 schematically illustrates a first example of an inner textile tubular element, particularly knitted, disposed in the foot-housing volume of a first example of an outer textile tubular element, particularly knitted, which can be implemented.

FIG. 3 schematically represents a first example of an inner textile tubular element 50 and a first example of an outer textile tubular element 60, distinct, each made of a knitted textile piece, particularly each made as a knitted sock. The inner textile tubular element 50 comprises a foot-covering inner textile part 52 and a sole inner textile part 54, as well as a bent portion 56 making it possible to form a heel region. In this precise example the foot-covering inner textile part 52 extends in the forefoot, midfoot, and heel regions, and does so from the lateral side to the medial side. In this precise example, the sole inner textile part 54 extends between a front edge and a back edge in the forefoot, midfoot, and heel regions, and does so from the lateral side to the medial side.

The outer textile tubular element 60 comprises a foot-covering outer textile part 62 and a sole outer textile part 64, as well as a bent portion 66 making it possible to form a heel region. In this precise example the foot-covering outer textile part 62 extends in the forefoot, midfoot, and heel regions, and does so between the lateral and medial sides. In this precise example, the sole outer textile part 64 extends between a front edge and a back edge in the forefoot, midfoot and heel regions, and between the lateral and medial sides.

The inner textile tubular element 50 is disposed in the housing volume 61 of the outer textile tubular element 60, and they are thus substantially at least partially superimposed. The inner 50 and outer 60 textile tubular elements are preferably placed on a foot-shaped preform (in particular the preform is disposed in the foot-housing volume of the inner textile tubular element 50), then undergo a step of thermoforming or thermocompression during which the hot-meltable textile portions of said inner textile tubular elements 50 and 60 are hot-melted so as to secure the inner textile tubular element 50 to the outer textile tubular element 60, and together form the shape of the foot-shaped preform. The inner 50 and outer 60 textile tubular elements are then cooled on the preform, preferably in order to set said shape.

During the thermoforming step, the preform is preferably stiff.

During the thermocompression step, the preform is an inflatable bladder (in particular made of a silicone or polyurethane material which can be inflated and deflated, and is therefore reusable). The heating temperature applied during the thermocompression step is determined so as to melt the hot-meltable material or materials in question more or less thoroughly. Thus, according to the desired effects, yarns may be bonded together and/or yarns may form a film or a coating, for example coating the inner textile tubular element 50, or the outer textile tubular element 60.

One or more sole elements, for example an outsole or else a flexible sole element made of a material having a Shore A hardness between 40 and 70, is/are disposed between the sole inner textile part 54 and the sole outer textile part 64.

Preferably, the sole inner 54 and outer 64 textile part essentially consist of hot-meltable yarn or yarns or each comprise at least 80% by mass of their total mass of hot-meltable yarn or yarns. Preferably, during the thermocompression step, the at least partially hot-meltable or entirely hot-meltable yarn or yarns of the sole inner and outer textile parts (54,64) are hot-melted.

Since the inner and outer textile tubular elements 50 and 60 are preferably distinct knitted pieces, they can have different configurations. For example, as represented on FIG. 3, the foot-covering outer textile part 62 covers the foot less than the foot-covering inner part 52, in particular a foot-covering outer textile part 62 does not comprise any instep and covers the ankle less than the covering inner textile part 52.

Figure 4:
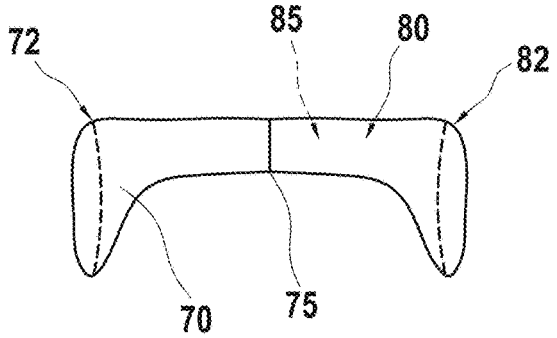
FIG. 4 schematically represents a second example of an inner textile tubular element, particularly knitted, and a second example of an outer textile tubular element, particularly knitted, which are of unitary textile construction, in particular in textile connection at the level of their foot insertion openings, and which can be implemented.

FIG. 4 schematically represents a second example of an inner textile tubular element 70 and a second example of an outer textile tubular element 80 which are of unitary textile construction, in particular made as a single U-shaped knitted piece. In this precise example, the inner and outer textile tubular elements 70 and 80 are in knitted textile connection at the levels of their foot insertion opening corresponding to the fold line 75 starting from which the inner tubular element 70 is tucked into the foot housing volume 85 of the outer textile tubular element 80. The inner 70 and outer 80 textile tubular elements are advantageously knitted socks, and each have a bent portion 72,82.

The inner and outer textile tubular elements 70,80 are disposed on a foot-shaped preform (not represented); in particular the preform is disposed in the foot-housing volume of the inner textile tubular element 70. The inner 70 and outer 80 textile tubular elements then undergo a step of thermoforming or thermocompression during which hot-meltable textile portions are hot-melted to secure said inner and outer textile tubular elements 70,80 to one another and to shape them to the shape of the preform.

Figure 5:
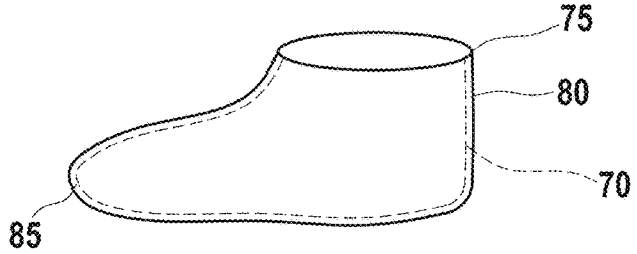
FIG. 5 schematically represents the inner textile tubular element, particularly knitted, of FIG. 4 disposed in the foot-housing volume of the outer textile tubular element, particularly knitted, of FIG. 4 when they are implemented.

The sole inner textile part 54 or 72, and the sole outer textile part 64 or 82, are represented as being configured to be disposed strictly under the foot on FIGS. 3 to 5. In another example, depending on the configuration of the chosen sole structure, the sole inner textile part 54 or 72, and/or the sole outer textile part 64 or 82, envelops or envelop a part of the top of the foot and along all or part of the circumference of the foot. The step of thermocompression can take place as described with reference to the first inner and outer textile tubular elements (50,60).

FIGS. 6 to 12 hereinafter essentially describe different examples of configurations of the inner and outer textile tubular elements, in particular different configurations of the superimposed main inner and outer textile portions.

Figure 6:
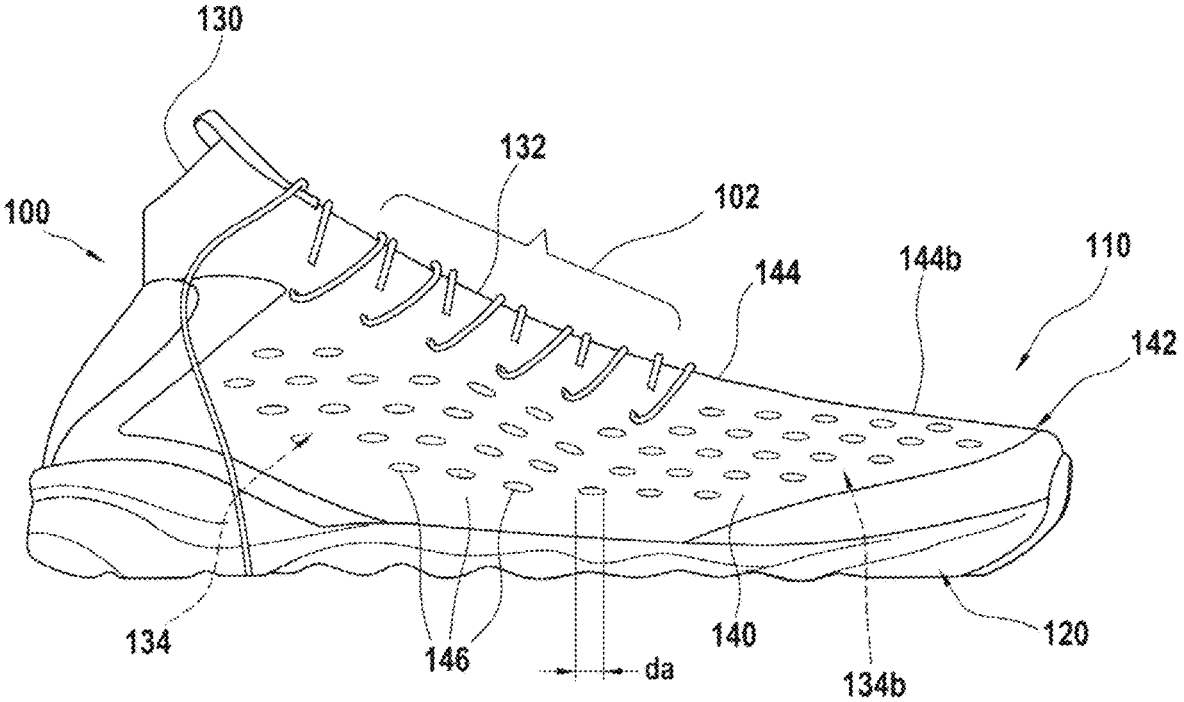
FIG. 6 schematically represents a second example of a shoe.

FIG. 6 schematically represents a shoe 100 comprising an upper 110 and a sole 120. The shoe 100 comprises an inner textile tubular element 130 at least partially disposed in the foot-housing volume of an outer textile tubular element 140. The upper 110 comprises the foot-covering inner textile part 132 of the inner textile tubular element 130 and the foot-covering outer textile part 142 of the outer textile tubular element 140.

Advantageously, the foot-covering outer textile part 142 comprises a main outer textile portion 144 which extends partially into the forefoot regions disposed between the medial and lateral sides and the forefoot regions disposed on the lateral side and on the medial side, and partially into the midfoot regions disposed on the medial and lateral sides. In particular, the main outer textile portion 144 does not extend into the instep area 102. Advantageously, the main outer textile portion 144 occupies at least 50%, preferably at least 80% of the total surface occupied by the forefoot and midfoot regions of the foot-covering outer textile part 142. The main outer textile portion 144 comprises, and in particular essentially consists of, transparent monofilament yarns forming a substantially continuous area of visualization extending in said regions. Said monofilament yarns are in a non-limiting example transparent monofilament yarns made of polyethylene terephthalate having a diameter in the order of 0.50 mm.

Advantageously, the main outer textile portion 144 comprises through openings 146, in particular through openings A as defined above, more particularly each having at least one dimension da greater than or equal to 2 or 3 mm. Said through openings 146 are preferably knitted at the same time as the outer textile tubular element 140.

Advantageously, the foot-covering inner textile part 132 comprises a main inner textile portion 134 partially superimposed with the main outer textile portion 144. In this example, the main inner textile portion 134 does not comprise any through openings. Advantageously, the foot-covering inner textile part 132 comprises a main inner textile portion 134 which extends at least partially in the forefoot regions disposed between the lateral and medial sides and over the lateral and medial sides, as well as in the midfoot regions over the lateral and medial sides. The foot-covering inner textile part 132 also extends in the instep area 102. The instep area 102 of the foot-covering inner textile part 132 thus forms a part of the outer face of the upper 110. Advantageously, the main inner textile portion 134 occupies at least 50%, preferably at least 80%, of the total surface occupied by the forefoot and midfoot regions disposed on the lateral and medial sides, and the forefoot region disposed between the lateral and medial sides, of the foot-covering inner textile part 132. The main inner textile portion 134, in particular its outer face 134*b*, is visible from the outer face 144*b* of the main outer textile portion 144. In particular, the color (here gray) and the textured appearance of the textile of the main inner textile portion 134 are visible from the area of visualization formed by the main outer textile portion 144.

Figure 7:
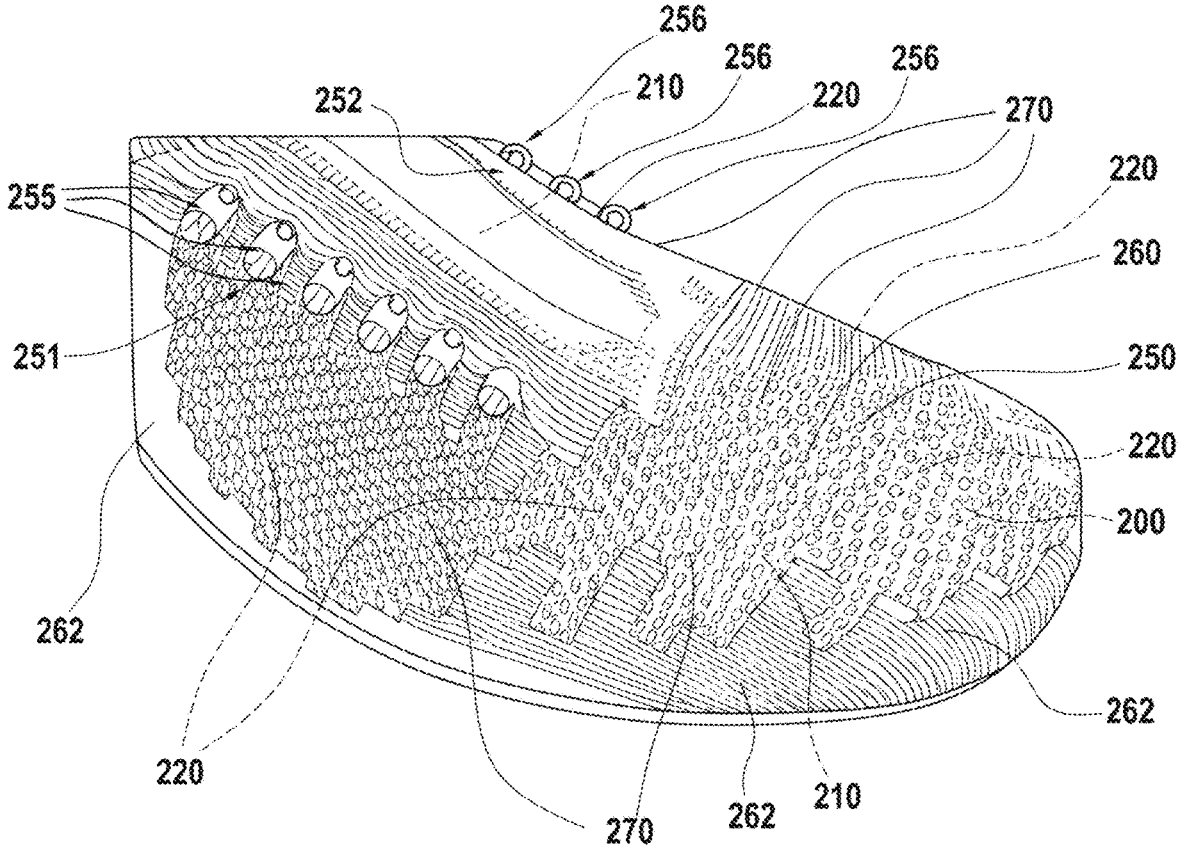
FIG. 7 schematically represents a third example of an arrangement of inner and outer textile tubular elements, particularly knitted, before their thermoforming, or thermocompression.

FIG. 7 schematically represents a third example of an inner textile tubular element 200 partially disposed in the foot-housing volume of a third example of an outer textile tubular element 250.

The outer textile tubular element 250 comprises a foot-covering outer textile part 260 comprising a main outer textile portion 270 essentially consisting of transparent monofilament yarns and partially extending in the forefoot and midfoot regions over the lateral and medial sides, and in the forefoot region between the lateral and medial sides, of the foot-covering outer textile part 260. Said monofilament yarns are in a non-limiting example transparent monofilament yarns made of polyethylene terephthalate having a diameter in the order of 0.35 mm, not intended to be hot-melted.

The inner textile tubular element 200 comprises a foot-covering inner textile part 210 comprising an main inner textile portion 220 partially extending in the forefoot and midfoot regions over the lateral and medial sides, and in the forefoot region between the lateral and medial sides, of the foot-covering inner textile part 210.

In this precise example, the main inner textile portion 210 comprises knitted stitches separated from one another by spaces forming through openings, in particular through openings B as described above, more particularly each having at least one dimension in the order of approximately 1 mm or less. The main outer textile portion 250 thus forms an area of visualization of the outer face of the first inner textile portion 210. It is possible to visualize the color, the pattern or patterns, and the knitted texture of the main inner textile portion 210.

In this precise example, the main outer textile portion 270 does not comprise any hot-melted yarns so that the knitted stitches in this latter are movable with respect to one another, the monofilament yarn being able to slide through said stitches. The main outer textile portion 270 thus retains a certain flexibility and is breathable, it is possible to expel transpiration and the heat accumulated between the main inner and outer textile portions (210,270), and in the foot-housing volume.

In this precise example, the main outer textile portion 270 is represented with a single type of stitching pattern (i.e. linkage of the yarns to one another) which repeats over its entire surface. However, the main outer textile portion 270 may comprise different stitching patterns arranged in distinct areas.

In this precise example, the outer textile tubular element 250 comprises two pairs 251,252 of knitted tubes 255,256 disposed respectively on either side of the instep area 210. The knitted tubes 255 disposed on the lateral side of the instep area interact with the knitted tubes 256 disposed on the medial site of the instep area to receive, for example, a lace. The knitted tubes 255,256 are of unitary knitted construction with the outer textile tubular element 250 also knitted.

In this precise example, the outer textile tubular element 260 comprises a single main outer textile portion 270. However, the outer textile tubular element 260 could comprise one or more distinct additional outer textile portions, in particular the main outer textile portion and the additional outer textile portion or portions are separated from one another by one or more intermediate outer textile portions not comprising any transparent and/or translucent monofilament yarns.

By way of non-limiting example, the foot-covering outer textile part 260 comprises knitted hot-meltable textile portions 262 which will be melted during the thermocompression step, preferably in a blend with knitted non-hot-meltable textile portions.

Preferably, the sole inner and outer textile parts are essentially composed of hot-meltable yarn or yarns which is/are hot-melted during the thermocompression step.

The hot-meltable yarns are in a non-limiting example multifilament yarns made of monocomponent polyurethane, in particular having a linear mass density between 50 dtex and 80 dtex, and the number of filaments between 30 and 45 filaments.

Figure 8:
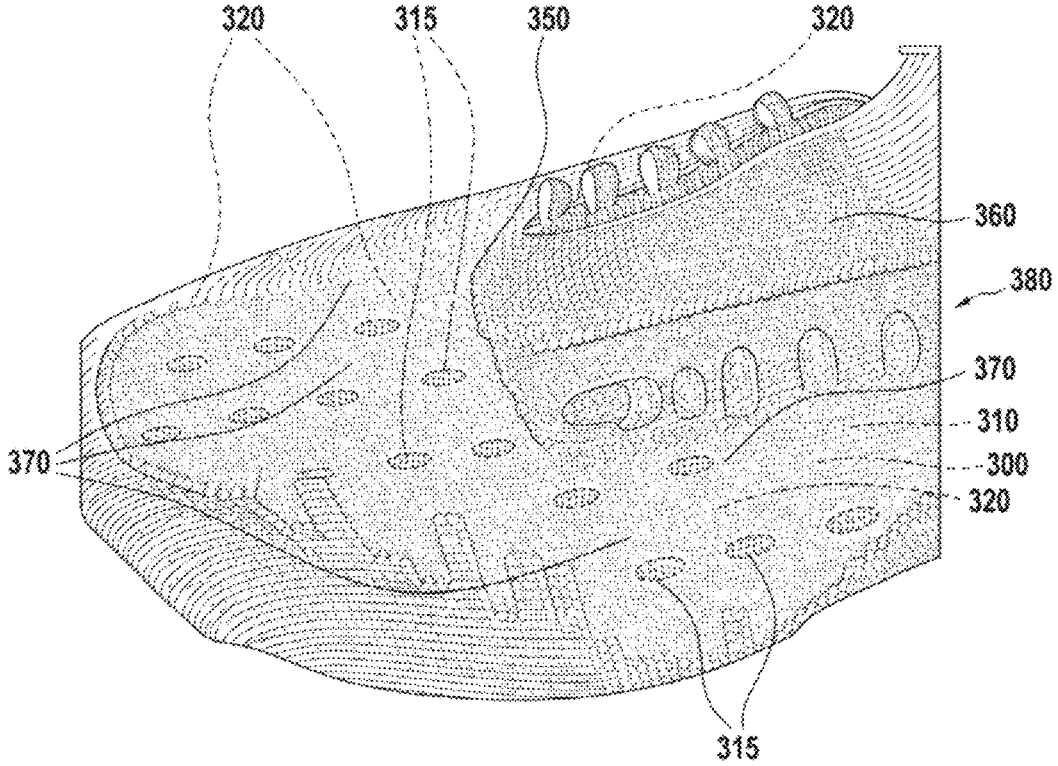
FIG. 8 schematically represents a fourth example of an arrangement of inner and outer textile tubular elements, particularly knitted, before their thermoforming or thermocompression.

FIG. 8 schematically represents a fourth example of an inner textile tubular element 300 partially disposed in the foot-housing volume of an outer textile tubular element 360 comprising a main outer textile portion 370 essentially consisting of transparent monofilament yarns and partially extending in the forefoot and midfoot regions over the lateral and medial sides, and in the forefoot region between the lateral and medial sides, of the foot-covering outer textile part 360. Said monofilament yarns are in a non-limiting example transparent monofilament yarns made of polyethylene terephthalate having a diameter in the order of 0.35 mm, not intended to be hot-melted.

The inner textile tubular element 300 comprises a foot-covering inner textile part 310 comprising a main inner textile portion 320 disposed in the forefoot and midfoot regions over the lateral and medial sides, and in the forefoot region between the lateral and medial sides, of the foot-covering inner textile part 320.

In this precise example, the main inner textile portion 310 comprises knitted through openings 315, in particular knitted through openings A as described above, more particularly having at least one dimension in the order of approximately 3-4 mm. The main outer textile portion 350 thus forms an area of visualization of the outer face of the main inner textile portion 310. It is possible to visualize the color, the pattern or patterns, the knitted texture as well as the through openings 315 of the main inner textile portion 310.

The through openings 315 of the main inner textile portion 310 make it possible to visualize the housing volume of the upper 380, particularly portions of the foot.

Figure 9:
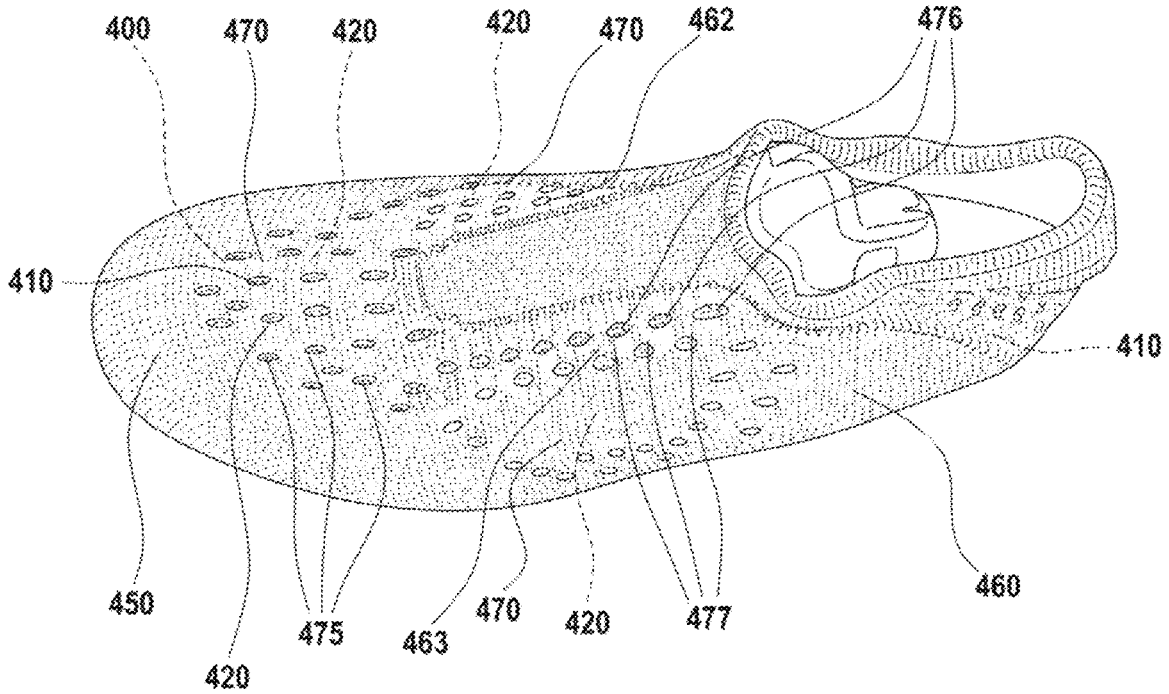
FIG. 9 schematically represents a fifth example of an arrangement of inner and outer textile tubular elements, particularly knitted, before their thermoforming or thermocompression.

FIG. 9 schematically represents a fifth example of an inner textile tubular element 400 partially disposed in the foot-housing volume of a fifth example of an outer textile tubular element 450. The outer textile tubular element 450 comprises a foot-covering outer textile part 460 comprising a main outer textile portion 470 essentially consisting of translucent monofilament yarns and partially extending in the midfoot region over the lateral and medial sides, and in the forefoot region between the lateral and medial sides, of the foot-covering outer textile part 460.

The inner textile tubular element 400 comprises a foot-covering inner textile part 410 comprising an inner textile portion 420 partially extending in the midfoot region over the lateral and medial sides, and in the forefoot region between the lateral and medial sides of the foot-covering inner textile part 410.

In this precise example, the main inner textile portion 420 comprises through openings, particularly knitted, in particular knitted through openings B as defined above, more particularly having at least one dimension in the order of approximately 1 mm or less. The main outer textile portion 470 thus forms an area of visualization of the outer face of the main inner textile portion 420. It is possible to visualize the color, the pattern or patterns, as well as the knitted texture of the main inner textile portion 420.

In this precise example, the main outer textile portion 470 comprises knitted through openings 475 A as defined above in this text, in particular having at least one dimension of approximately 3 to 5 mm.

Advantageously, the through openings 475 of the main outer textile portion 470 have at least one dimension greater than at least one of the dimensions of each of the through openings B of the main inner textile portion 420.

In this exemplary embodiment, the knitted through openings are distributed over the forefoot region disposed between the lateral and medial sides, and partially border the main outer textile portion 470 in the midfoot regions on the lateral side and on the medial side.

For example, the foot-covering outer textile part 460 comprises first and second sets 462,463 of through openings 476 forming lace buckles or textile bridges 477 in the instep area. A lacing buckle 476 is delimited by two adjacent through openings 476 disposed transversally to the longitudinal axis of the outer textile tubular element 450. The through openings 476 are of unitary textile construction, in particular knitted, with the outer textile tubular element 450.

On FIG. 9, the main outer textile portion 470 extends substantially continuously in the forefoot and midfoot regions. The main outer textile portion 470 could alternatively be disposed solely in the forefoot region between the lateral and medial sides, and the outer textile tubular element 450, in particular its outer covering textile part 460, could comprise a (first) additional outer textile portion disposed in the midfoot region on the lateral side and another (second) additional outer textile portion disposed in the midfoot region on the medial side. The main and additional outer textile portions are in this case distinct from one another, and optionally separated by one or more intermediate textile portions not comprising any transparent monofilament yarn. The same alternative arrangement can be adopted with the inner textile tubular element 410.

Figure 10:
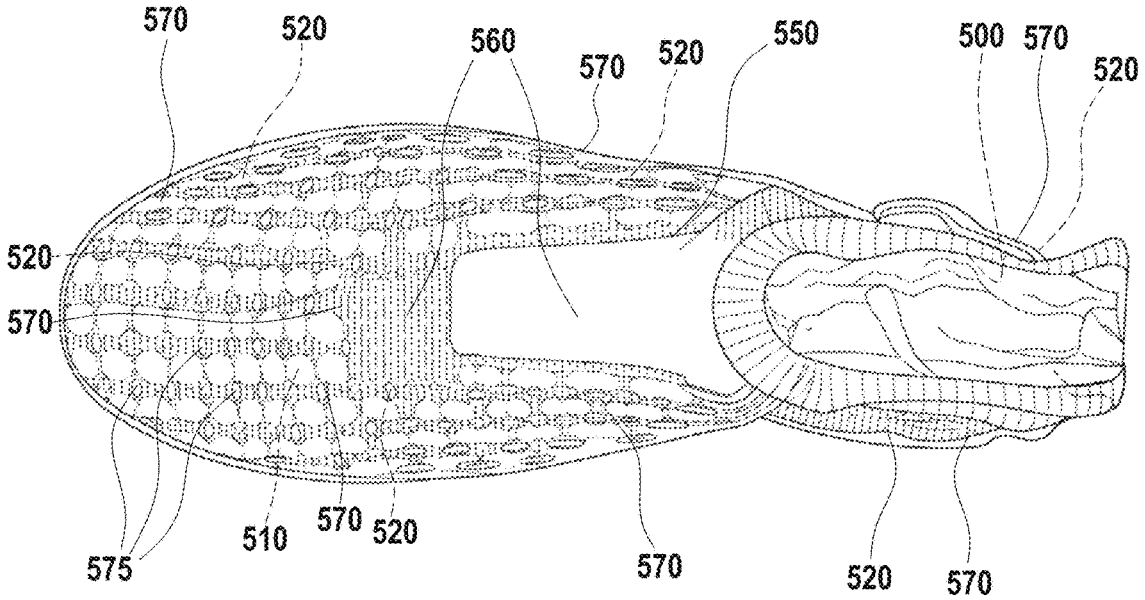
FIG. 10 schematically represents a sixth example of an arrangement of inner and outer textile tubular elements, particularly knitted, before their thermoforming or thermocompression in top view.
Figure 11:
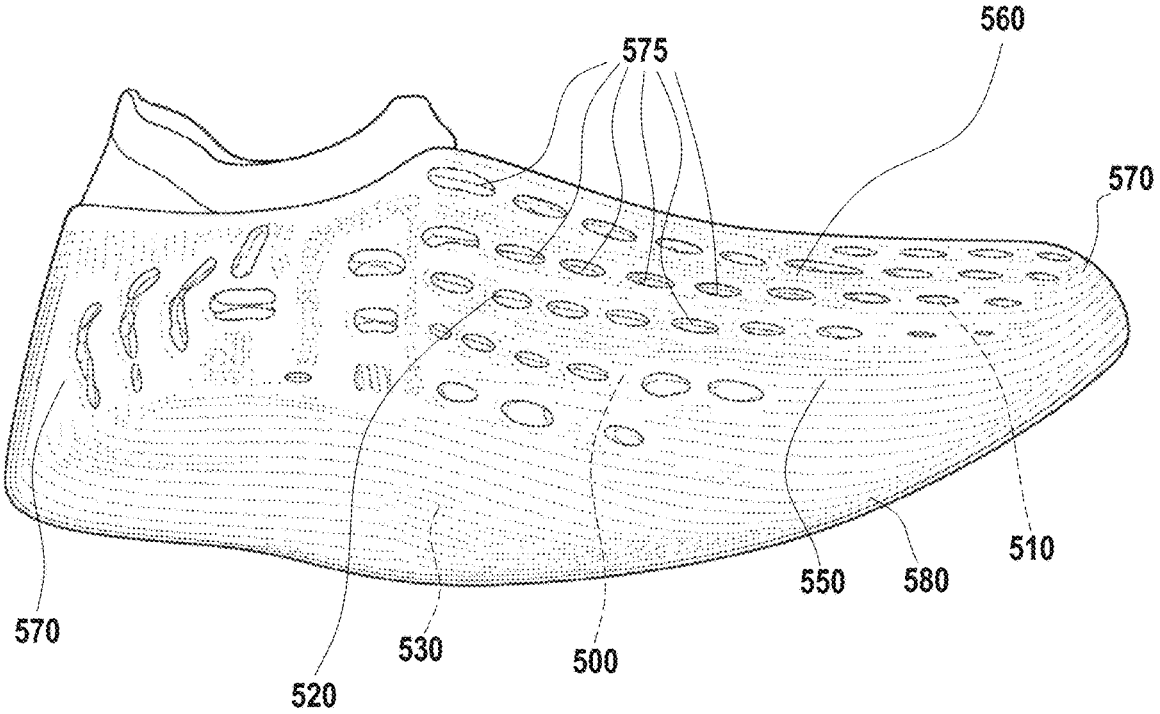
FIG. 11 schematically represents the inner and outer textile tubular elements, particularly knitted, of FIG. 10 before their thermoforming or thermocompression in side view.

FIGS. 10 and 11 schematically represent a sixth example of an inner textile tubular element 500 partially disposed in the foot-housing volume of an outer textile tubular element 550. The outer textile tubular element 550 comprises a foot-covering outer textile part 560 comprising a main outer textile portion 570 essentially consisting of transparent monofilament yarns and partially extending in the forefoot, midfoot and hindfoot regions, and over and between the lateral and medial sides, of the foot-covering outer textile part 560.

The inner textile tubular element 500 comprises a foot-covering inner textile part 510 comprising a main inner textile portion 520 partially extending in the forefoot, midfoot and heel regions, and over and between the lateral and medial sides, of the foot-covering inner textile part 510.

In this precise example, the main inner textile portion 510 comprises through openings, in particular through openings B as defined above, more particularly having at least one dimension in the order of 1 mm. The main outer textile portion 550 thus forms an area of visualization of the outer face of the main inner textile portion 510. It is possible to visualize the color, the pattern or patterns, as well as the texture, particularly knitted, of the main inner textile portion 510.

In this precise example, the main outer textile portion 570 comprises through openings 575, in particular through openings A as defined above, more particularly having at least one dimension of approximately 3 to 5 mm, and having at least one dimension greater than at least one of the dimensions of the through openings of the main inner textile portion 510.

In this precise example, the through openings 575 are disposed in the forefoot, midfoot and heel region, and this over and between the lateral and medial sides, of the foot-covering outer textile part 560.

Preferably, the sole inner 530 and outer 580 textile parts essentially consist of hot-meltable monocomponent multifilament yarns, in particular made of hot-meltable polyurethane. These yarns are therefore hot-melted on the finished shoe.

Figure 12:
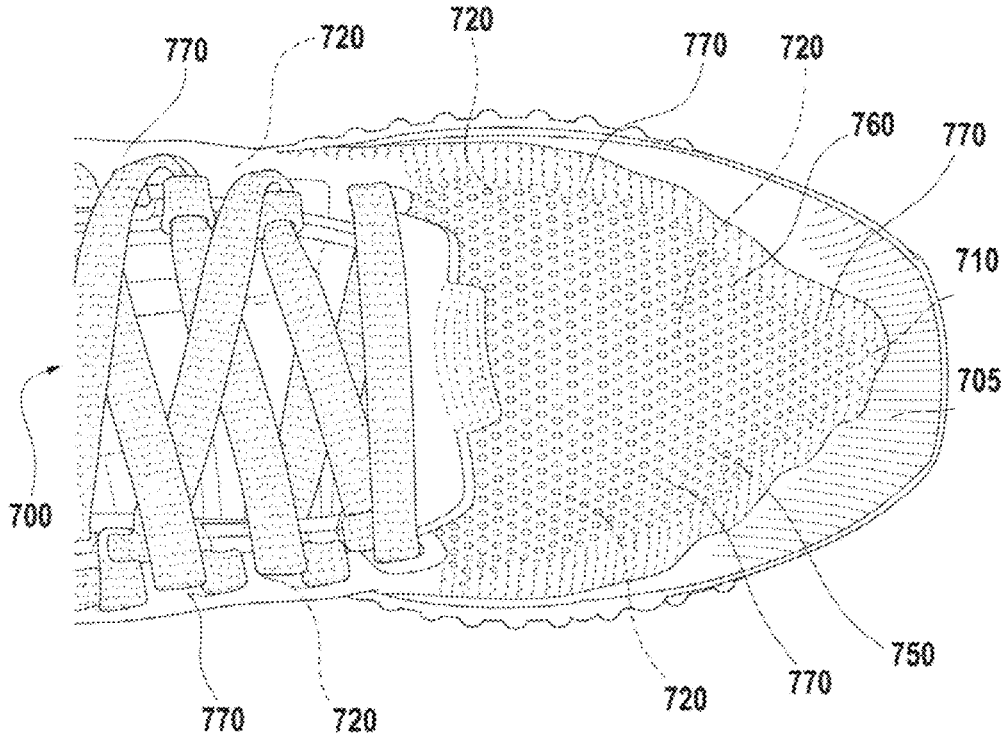
FIG. 12 schematically represents a third example of a shoe.

FIG. 12 schematically and partially represents a third example of a shoe 700 comprising an inner textile tubular element 705 partially disposed in the foot-housing volume of the outer textile tubular element 750.

The outer textile tubular element 750 comprises a foot-covering outer textile part 760 comprising a main outer textile portion 770 essentially consisting of transparent monofilament yarns and partially extending into the forefoot and midfoot regions; and this over and between the lateral and medial sides.

The inner textile tubular element 705 comprises an foot-covering inner textile part 710 comprising an main inner textile portion 720 also essentially consisting of transparent monofilament yarns partially extending in the forefoot and midfoot regions; and over and between the lateral and medial sides.

Said monofilament yarns are in a non-limiting example transparent monofilament yarns made of polyethylene terephthalate having a diameter in the order of 0.35 mm, not intended to be hot-melted.

In this precise example, the main outer and inner textile portions 720,770 may each comprise through openings according to the chosen stitching patterns, in particular through openings B as defined above, more particularly having at least one dimension of 1 mm or less.

The main outer textile portion 770 forms an area of visualization of the main inner textile portion 720. The main inner textile portion 720 forms an area of visualization of the foot-housing volume. It is possible to see the inside the shoe in this configuration.

Figure 13:
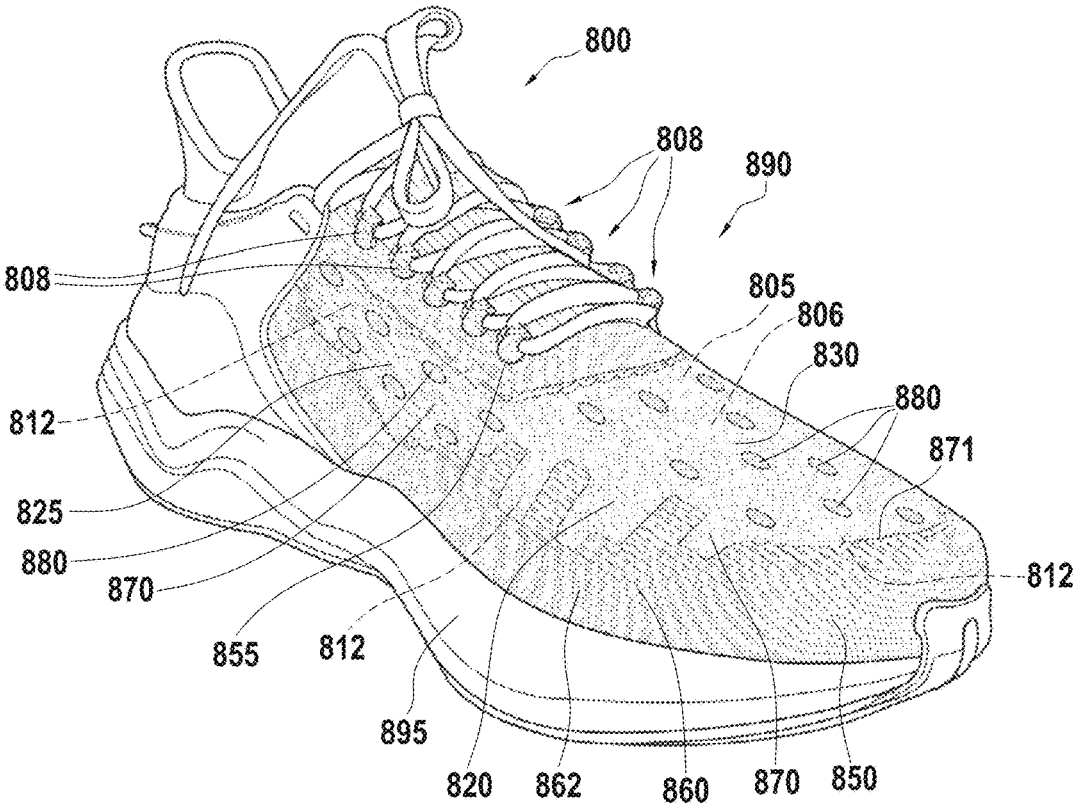
FIG. 13 schematically represents a fourth example of a shoe in perspective view and from its medial side.
Figure 14:
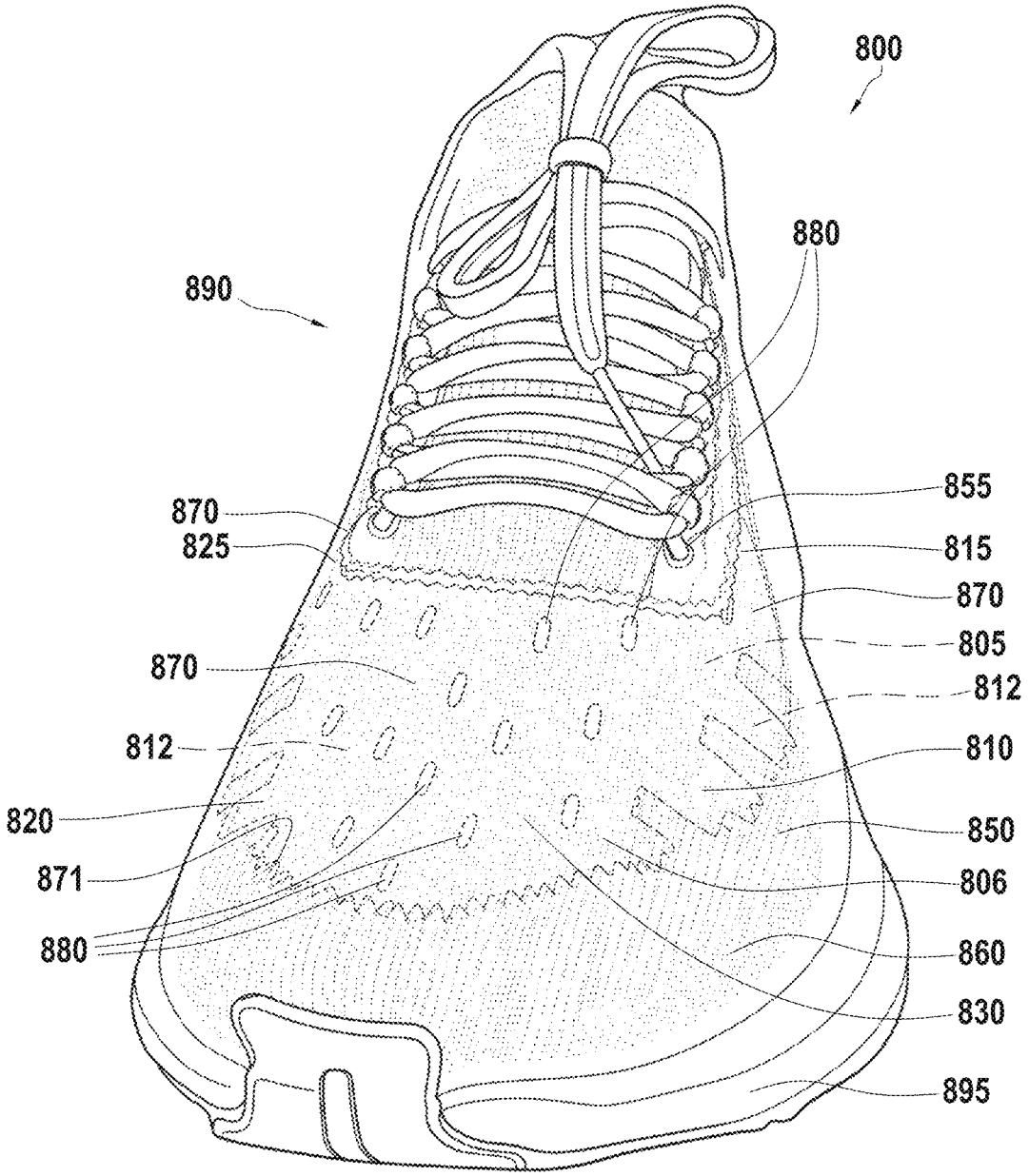
FIG. 14 schematically represents the fourth example of a shoe in front view.

FIGS. 13 and 14 schematically represent a fourth example of a shoe 800, particularly a sports shoe, comprising an outer textile tubular element 850 and an inner textile tubular element 805 folded into the foot-housing volume of the outer textile tubular element 850.

In this example, the outer textile tubular element 850 comprises a foot-covering outer textile part 860, i.e. covering all or part of the top of the foot, and a (non-visible) sole part covering all or part of the bottom of the foot. The outer textile tubular element 850 comprises a main outer textile portion 870 knitted with a transparent monofilament yarn; said main outer textile portion 870 extends partially in the forefoot and midfoot regions disposed on the lateral (810, 815) and medial (820,825) sides, and partially in the forefoot region disposed between the lateral and medial sides 830 of the foot-covering outer textile part 860. Said transparent monofilament yarn preferably has a diameter of approximately 0.15 mm, and is made of an olefinic thermoplastic elastomer, in particular based on propylene and ethylene, having a shrink ratio of approximately 9% (tested shrinkage conditions: heating at 180° C. for 2 minutes).

In this example, the inner textile tubular element 805 comprises through openings 880 knitted with one or more multifilament yarns, and disposed in the foot-covering inner textile part 806, in particular covering all or part of the top of the foot, in the forefoot and midfoot regions disposed on the lateral and medial sides, and partially in the forefoot region disposed between the lateral and medial sides of said foot-covering inner textile part. In particular, the through openings 880 have at least one dimension greater than or equal to approximately 10 mm, for example of approximately 10-12 mm. Each of the medial and lateral regions comprises, in this precise example, seven through openings. Said through openings, given their size, are of type A as described in this text. The forefoot region comprises, in this precise example, fifteen through openings. The textile portion 812 of the inner textile tubular element 805 covered by the main outer textile portion 870 forms the main inner textile portion.

During the manufacturing of the upper, the monofilament yarn is loosely knitted. After knitting, the inner textile tubular element 805 is disposed in the foot-housing volume of the outer textile tubular element 850, then the inner and outer textile tubular elements (805,850) thus superimposed are disposed on an upper-shaped preform and undergo a step of heat-shrinking, in particular the application of water vapor for approximately 3 minutes, to activate the dimensional shrinkage of the transparent monofilament yarn. Then, the superimposed textile tubular elements undergo a step ii) of thermoforming to the shape of the preform so as to obtain the melting or softening of the hot-meltable textile parts provided by the at least partially hot-meltable yarns. The superimposed tubular elements (805,850) are left to cool on the preform in order to set the shape, then the obtained upper 890 is assembled with a sole assembly 895.

In this precise example, the inner textile tubular element 805 comprises a set of knitted buckle frames 808 disposed in the instep region of the upper 890, and the outer textile tubular element 850 comprises a set of through openings 855 disposed in the instep region of the upper 890 and through which extend said buckle frames 808. The frames advantageously form lacing areas for passing a lace through.

Advantageously, the through openings 880 are protected by the outer textile tubular element 850 which covers them, in particular by the main outer textile portion 870 which is monofilament, transparent and abrasion-resistant. In addition, it is possible for the user to visualize these through openings 880, which helps to impart an original appearance.

Advantageously, the permeability of the upper of the shoe 800 is improved by comparison with a similar shoe not comprising any through openings 880, or monofilament yarns. The permeability of the textile complex comprising the superimposed inner and outer textile tubular elements (805,850), measured in the forefoot region, is of approximately 1043.8 $l/m^2/s$ whereas the permeability of a comparable complex not comprising any through openings, or monofilament yarns, is of 439.2 $m/m^2/s$. The permeability is determined according to the ISO 9237-1995 standard.

The through openings are thus advantageously protected from tearing, considerably improve the permeability of the shoe and therefore the expelling of heat and transpiration, and are visible from the outside of the shoe, thus facilitating the understanding of the operation of the shoe.

Advantageously, the elongation of the upper of the shoe 800 is improved by comparison with a similar shoe not comprising the through openings 880, or monofilament yarns. The elongation of the textile complex comprising the superimposed inner and outer textile tubular elements (805, 850) under a force of 15 Newtons is of approximately 17.25 mm whereas the elongation of a comparable complex not comprising any through openings, or monofilament yarns, is of 10.8 mm. The elongation is determined on a piece of a temperature of approximately 20° C.+/−2° C., and of relative humidity of 65% to +/−4%, a tested sample has a length of 150 mm and a width of 50 mm, the speed of the tensioning machine is of 200 mm/min, and the grip width is of 100 mm. The measured elongation corresponds to that obtained at the end of two tensioning cycles. The test can be done on a tensile testing bench suitable for the textile and marketed by the company Instron.

Advantageously, the elongation of the upper advantageously improved by approximately 60% even though monofilament yarns, by definition stiffer than multifilament yarns, are used.

Figure 15:
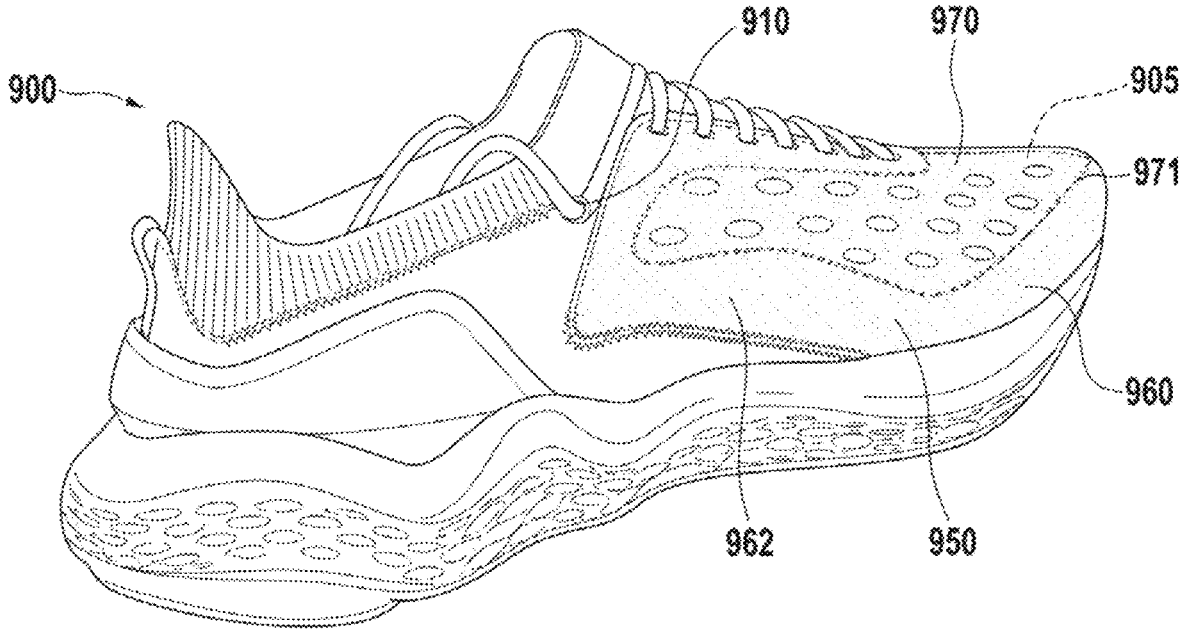
FIG. 15 schematically represents a fifth example of a shoe in perspective view and from its lateral side.
Figure 16:
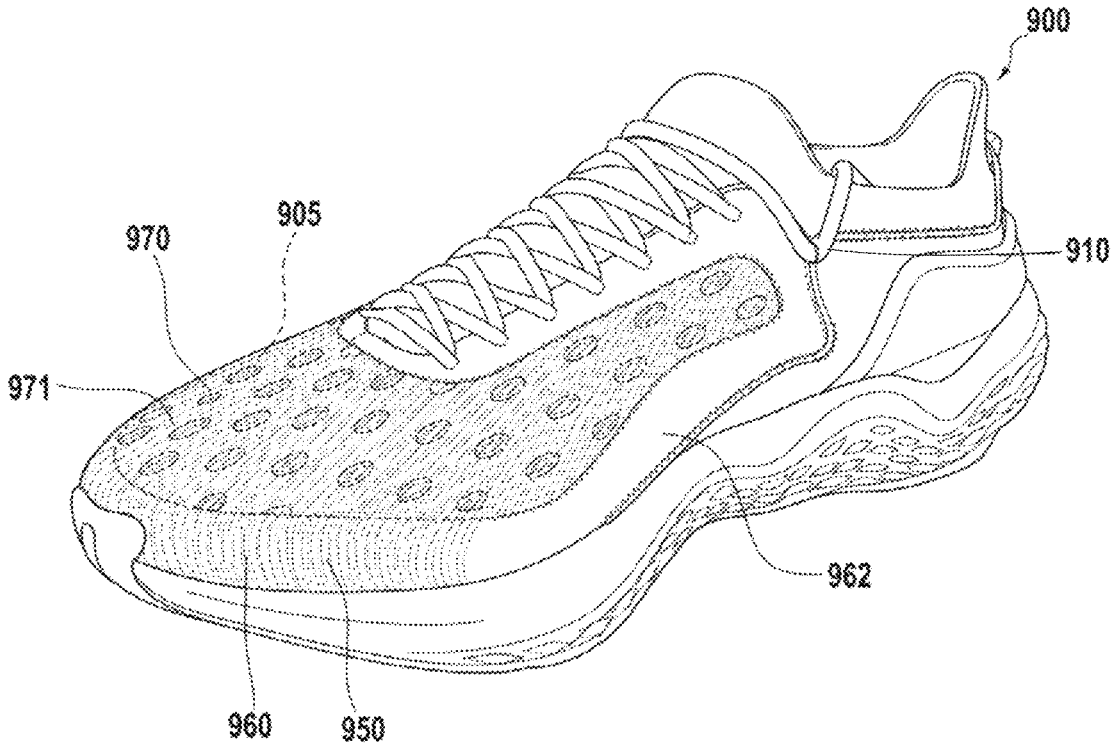
FIG. 16 schematically represents the fifth example of a shoe in perspective view and from its medial side.

FIGS. 15 and 16 schematically represent a fifth example of a shoe 900, particularly a sports shoe, comprising an outer textile tubular element 950 and an inner textile tubular element 905 folded into the foot-housing volume of the outer textile tubular element 950. The shoe 900 is similar to the shoe 800. The shoe 900 differs from the shoe 800 by virtue of the lacing system, the ends of a lace being disposed in a buckle frame 910 sewn onto the foot-covering outer textile part 960. In addition, the main outer textile portion 970 of the foot-covering outer textile part 960 has a contour without any notches.

In an embodiment, and as can be seen on the different variants of FIGS. 7,8, and 12 to 16; the main outer textile portion, for example 970 or 970, is separated from the sole outer textile part of the outer textile tubular element, for example 850 or 950, by at least one portion for joining said outer textile tubular element not comprising any monofilament yarn or yarns, in particular transparent and/or translucent, such as for example the joining textile portion 862 or 962. In particular, the joining textile portion, for example 862 or 962, borders, partially or substantially entirely, the lower edge, for example 871 or 971, of the main outer textile portion, for example 870 or 970.

This disposition makes it possible to reinforce the connection between the upper and the sole structure.

The invention claimed is:

1. A shoe comprising an upper, said upper comprising at least a part of an outer textile tubular element, and at least a part of an inner textile tubular element, said inner and outer textile tubular elements being at least partially superimposed, at least one of said inner and outer textile tubular elements comprises at least one hot-melted textile portion, wherein the outer textile tubular element comprises at least one main outer textile portion and the inner textile tubular element comprises at least one main inner textile portion, wherein the main outer textile portion and the main inner textile portion are at least partially superimposed, and wherein the main outer textile portion comprises one or more transparent and/or translucent monofilament yarn(s) forming an area of visualization of the main inner textile portion, and wherein the transparent and/or translucent monofilament yarn or yarns is not/are not hot-melted.

2. The shoe as claimed in claim 1, wherein at least one yarn chosen from among the transparent and/or translucent monofilament yarn or yarns of the main outer textile portion comprises one or more thermoplastic elastomers.

3. The shoe as claimed in claim 2, wherein the one or more thermoplastic elastomers is/are olefinic thermoplastic elastomers.

4. The shoe as claimed in claim 2, wherein the one or more thermoplastic elastomers is/are olefinic thermoplastic elastomers based on propylene and ethylene.

5. The shoe as claimed in claim 1, wherein at least one yarn chosen from among the transparent and/or translucent monofilament yarn or yarns of the main outer textile portion has a diameter greater than or equal to 0.05 mm and less than or equal to 0.8 mm.

6. The shoe as claimed in claim 1, wherein said main outer textile portion is disposed in at least a region chosen from the following regions of the upper: a forefoot region extending over the lateral side; a forefoot region extending over the medial side; a forefoot region extending between the medial and the lateral sides; a mid-foot region extending on the lateral side; a mid-foot region extending on the medial side; a mid-foot region extending on the medial and lateral sides; a heel region extending over the lateral side; a heel region extending over the medial side; a heel region extending between the medial and lateral sides, or a combination thereof.

7. The shoe as claimed in claim 6, wherein the main inner and outer portions are disposed at least partially in the midfoot region extending over the lateral side of the upper, and wherein the inner textile tubular element further comprises an additional inner textile portion and the outer textile tubular element comprises an additional outer textile portion, the additional inner and outer textile portions are at least partially superimposed and disposed at least in the midfoot region on the medial side of the upper, the additional outer textile portion comprises one or more transparent and/or translucent monofilament yarns forming an area of visualization of the additional inner textile portion.

8. The shoe as claimed in claim 1, wherein the outer textile tubular element is a knitted sock comprising a foot-receiving void, and the inner textile tubular element is a knitted sock at least partially disposed in the foot-receiving void of the outer textile tubular element.

9. The shoe as claimed in claim 8, wherein the foot insertion opening, or the foot tip, of the outer textile tubular element is in textile connection with the foot insertion opening, or the foot tip, of the inner textile tubular element.

10. The shoe as claimed in claim 1, wherein the outer textile tubular element and the inner textile tubular element are of unitary textile construction.

11. The shoe as claimed claim 1, wherein the main inner textile portion does not comprise any hot-melted textile portion.

12. The shoe as claimed in claim 1, wherein the main inner textile portion comprises one or more non-hot-melted transparent and/or translucent monofilament yarns.

13. The shoe as claimed in claim 1, wherein the inner textile tubular element comprises one or more hot-melted textile portions, and wherein the outer textile tubular element does not comprise any hot-melted textile portion.

14. The shoe as claimed in claim 1, wherein the main outer textile portion comprises one or more textile through knitted openings.

15. The shoe as claimed in claim 14, wherein the main outer textile portion comprises one or more through openings which is not/are not facing a through opening or through openings of the main inner textile portion.

16. The shoe as claimed in claim 1, wherein the main outer textile portion (comprises an inner face portion and the main inner textile portion comprises an outer face portion which is not bonded to the inner face portion of the main outer textile portion.

17. The shoe as claimed in claim 1, wherein the main outer textile portion comprises one or more transparent and/or translucent monofilament yarn(s) having a three-lobed cross-section.

18. A shoe comprising an upper, said upper comprising at least a part of an outer textile tubular element, and at least a part of an inner textile tubular element, said inner and outer textile tubular elements being at least partially superimposed, at least one of said inner and outer textile tubular elements comprises at least one hot-melted textile portion, wherein the outer textile tubular element comprises at least one main outer textile portion and the inner textile tubular element comprises at least one main inner textile portion, wherein the main outer textile portion and the main inner textile portion are at least partially superimposed, and wherein the main outer textile portion comprises one or more transparent and/or translucent monofilament yarn(s) forming an area of visualization of the main inner textile portion, wherein at least one yarn chosen from among the transparent and/or translucent monofilament yarn or yarns of the main outer textile portion comprises one or more thermoplastic elastomers, and wherein the one or more thermoplastic elastomers is/are olefinic thermoplastic elastomers.

19. A shoe comprising an upper, said upper comprising at least a part of an outer textile tubular element, and at least a part of an inner textile tubular element, said inner and outer textile tubular elements being at least partially superimposed, at least one of said inner and outer textile tubular elements comprises at least one hot-melted textile portion, wherein the outer textile tubular element comprises at least one main outer textile portion and the inner textile tubular element comprises at least one main inner textile portion, wherein the main outer textile portion and the main inner textile portion are at least partially superimposed, and wherein the main outer textile portion comprises one or more transparent and/or translucent monofilament yarn(s) forming an area of visualization of the main inner textile portion, wherein the inner textile tubular element comprises one or more hot-melted textile portions, and wherein the outer textile tubular element does not comprise any hot-melted textile portion.

* * * * *